US008267076B2

(12) United States Patent
Nakagawa et al.

(10) Patent No.: US 8,267,076 B2
(45) Date of Patent: Sep. 18, 2012

(54) ENGINE CONTROL APPARATUS

(75) Inventors: Shinji Nakagawa, Mito (JP); Kazuhiko Kanetoshi, Hitachinaka (JP); Kouzou Katogi, Hitachi (JP); Takanobu Ichihara, Tsuchiura (JP); Minoru Ohsuga, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 151 days.

(21) Appl. No.: 12/826,367

(22) Filed: Jun. 29, 2010

(65) Prior Publication Data

US 2011/0029218 A1 Feb. 3, 2011

(30) Foreign Application Priority Data

Jul. 28, 2009 (JP) ..... 2009-175217

(51) Int. Cl.
*F02D 41/10* (2006.01)

(52) U.S. Cl. ..... 123/675; 123/682; 123/492; 123/399; 123/406.25; 123/406.46; 123/406.51

(58) Field of Classification Search ..... 701/103–105, 701/109–110; 123/672–675, 679, 682, 492, 123/443, 399, 406.18, 406.23, 406.24, 406.25, 123/406.36, 406.46, 406.5, 406.51, 406.58
See application file for complete search history.

(56) References Cited

U.S. PATENT DOCUMENTS

2011/0100327 A1* 5/2011 Nakagawa et al. ..... 123/445

FOREIGN PATENT DOCUMENTS

JP 7-317586 * 12/1995
JP 2000-205025 A2 7/2000
JP 2004-346807 A 12/2004

OTHER PUBLICATIONS

Japanese Office Action including English language translation dated Nov. 1, 2011 (Five (5) pages).

* cited by examiner

*Primary Examiner* — Hai Huynh
(74) *Attorney, Agent, or Firm* — Crowell & Moring LLP

(57) ABSTRACT

The present invention performs correction appropriately according to errors in the fuel system and air system respectively and corrects both variations in the air-fuel ratio and torque. When the difference between a target air-fuel ratio and a real air-fuel ratio is equal to or below a predetermined value when feedback control based on the air-fuel ratio of an exhaust manifold 10A is in progress, the air-fuel ratio of a cylinder cyl_1 having the largest variation of angular acceleration is corrected to the rich side, for example, by increasing the amount of fuel. Angular acceleration per cylinder is then detected again and when the variation in angular acceleration among cylinders is not eliminated, it is judged that there is an error in the amount of air control of the cylinder having the largest variation and the amount of air, amount of fuel, ignition timing or the like are corrected.

6 Claims, 31 Drawing Sheets

ENGINE CONTROL APPARATUS

BACKGROUND OF THE INVENTION

1. Field of the Invention

The present invention relates to an engine control apparatus, and more particularly, to a control apparatus that detects and/or corrects variations in both the amount of fuel and the amount of air among cylinders.

2. Background Art

Against a background of problems with the global environment, there is an ever increasing demand for automobiles emitting less exhaust and less $CO_2$ (less fuel consumption). In order to improve performance of engines, engines provided with a mechanism that controls the amount of fuel and amount of air supplied to the engine independently of each other, for example, by adopting a variable valve, are becoming widespread. In such engines, it is necessary to guarantee the performance of controlling the amount of fuel and the amount of air independently of each other in a practical environment, too.

JP Patent Publication (Kokai) No. 2004-346807A discloses an invention that detects, when a difference between an average value of a target air-fuel ratio and that of a real air-fuel ratio over a predetermined period exceeds a predetermined value, an abnormal cylinder based on a rotation variation and corrects the air-fuel ratio of the cylinder based on a fuel injection amount.

SUMMARY OF THE INVENTION

In the mechanism which controls the amount of fuel and the amount of air independently of each other, the amount of fuel and the amount of air may vary from one cylinder to another. In this case, attempting to perform control so as to eliminate only the variation in the air-fuel ratio among cylinders may result in a variation in torque among cylinders and may rather deteriorate stability (operability) of the engine.

For example, when the amount of air of only a specific cylinder increases unintentionally, only the air-fuel ratio of the cylinder becomes lean. When the leanness is corrected by increasing only the fuel injection amount of the cylinder, torque of only the cylinder in question increases and stability deteriorates.

The present invention has been implemented in view of the above described problems and it is an object of the present invention to provide an engine control apparatus that appropriately performs correction according to causes of errors and corrects variations in both the air-fuel ratio and torque.

In order to attain the above described object, as shown in FIG. 1, a first aspect of the engine control apparatus according to the present invention is an engine control apparatus for an engine 40 with a plurality of cylinders, including means 53 for performing feedback control of an air-fuel ratio based on a real air-fuel ratio of an exhaust manifold that communicates with each of the cylinders, means 50 for judging that a difference between a target air-fuel ratio and the real air-fuel ratio is equal to or below a predetermined value during the air-fuel ratio feedback control, means 51 for detecting a cylinder having a largest variation of angular acceleration of a crank shaft of the plurality of cylinders when the difference between the target air-fuel ratio and the real air-fuel ratio is judged to be equal to or below the predetermined value, and means 52 for correcting the air-fuel ratio of the cylinder having the largest variation of angular acceleration to a rich side or correcting the air-fuel ratio of a cylinder other than the cylinder having the largest variation of angular acceleration to a lean side.

In an engine having a plurality of cylinders, when an air-fuel ratio of a certain cylinder becomes lean, a fuel injection amount is corrected by a same amount for all cylinders so that the air-fuel ratio of the exhaust manifold becomes a target air-fuel ratio (generally, a theoretical air-fuel ratio) when feedback control based on the air-fuel ratio of the exhaust manifold that communicates with each of the cylinders is in progress.

The air-fuel ratio of the exhaust manifold is often detected after exhausts of all the cylinders are sufficiently mixed. This is attributable to the fact that in an operation region where exhaust flows slowly, the exhaust is mixed with exhausts from other cylinders before it reaches the exhaust manifold, and an air-fuel ratio sensor is set up at a position not susceptible to sensitivity of a specific cylinder, which consequently makes it hard to detect the air-fuel ratio for each cylinder.

As a result, it is a common practice that the fuel injection amounts of all the cylinders are uniformly corrected so that the average air-fuel ratio of all the cylinders becomes the target air-fuel ratio. Therefore, when a certain cylinder becomes lean, the average air-fuel ratio of all the cylinders also shifts to the lean side, which causes a function to automatically operate whereby the fuel injection amounts of all the cylinders are corrected so as to uniformly increase by the amount of the shift.

As a result, the air-fuel ratio of the exhaust manifold (average air-fuel ratio of all the cylinders) substantially converges to the target air-fuel ratio, and the lean cylinder still remains lean though its degree of leanness decreases and other cylinders rather become rich.

On the premise of this operation condition, the means described in the first aspect is performed. That is, as described in the first aspect, it is judged that a difference between the target air-fuel ratio and the real air-fuel ratio is equal to or below a predetermined value when feedback control based on the air-fuel ratio of the exhaust manifold is in progress.

When the difference between target air-fuel ratio and the real air-fuel ratio is judged to be equal to or below the predetermined value (the real air-fuel ratio converges to the vicinity of the target air-fuel ratio), a variation of angular acceleration correlated with an in-cylinder pressure is detected (calculated) cylinder by cylinder. A cylinder having a large variation of angular acceleration is judged to be a lean cylinder and the air-fuel ratio of the lean cylinder is corrected to the rich side.

In this case, the air-fuel ratio of the exhaust manifold (average air-fuel ratio of all the cylinders) temporarily shifts to the rich side due to the influence that the air-fuel ratio of the lean cylinder has been corrected to the rich side, but the air-fuel ratio feedback control functions so that all the cylinders are uniformly corrected to the lean side accordingly, and as a result, the air-fuel ratios of all the cylinders are controlled to the vicinity of the target air-fuel ratio. Alternatively, the air-fuel ratio of the cylinder other than the cylinder having a large variation of angular acceleration may be corrected to the lean side.

In this case, the air-fuel ratio of the exhaust manifold (average air-fuel ratio of all the cylinders) temporarily shifts to the lean side due to the influence that the air-fuel ratio of the cylinder other than the lean cylinder has been corrected to the lean side, but the air-fuel ratio feedback control functions so that all the cylinders are uniformly corrected to the rich side, and therefore the air-fuel ratios of all the cylinders are controlled to the vicinity of the target air-fuel ratio in this case, too.

When attention is focused on a specific cylinder, the air-fuel ratio is not always shifted to the lean side, and even if the air-fuel ratio is shifted to the rich side, the air-fuel ratio feedback control causes the other cylinders to shift to the lean side and lean cylinders are generated anyway. Moreover, by frequently performing this control, it is possible to successively correct only the leanest cylinder and consequently suppress variations in air-fuel ratios of all the cylinders all the time.

In a second aspect of the engine control apparatus according to the present invention, as shown in FIG. 2, the means 52 for correcting the air-fuel ratio of the cylinder having the largest variation of angular acceleration according to the first aspect to the rich side corrects the amount of fuel of the cylinder having the largest variation of angular acceleration so as to increase or corrects the amount of air so as to decrease. This clearly indicates that the amount of fuel of the cylinder to be corrected is increased or the amount of air is decreased as a scheme whereby the air-fuel ratio of a cylinder with a large variation of angular acceleration is corrected to be rich.

In a third aspect of the engine control apparatus according to the present invention (FIG. 3), the means 52 for correcting the air-fuel ratio of a cylinder other than the cylinder having the largest variation of angular acceleration according to the first aspect to the lean side corrects the amounts of fuel of the cylinder other than the cylinder having the largest variation of angular acceleration so as to decrease or corrects the amount of air to increase. This clearly indicates that the amount of fuel of the cylinder to be corrected is decreased or the amount of air is increased as a scheme whereby the air-fuel ratio of the cylinder other than the cylinder having a large variation of angular acceleration are corrected to be lean.

A fourth aspect of the engine control apparatus according to the present invention (FIG. 4) includes, in addition to the above described configuration, after correcting the air-fuel ratio of a cylinder cyl_1 having the largest variation of angular acceleration to the rich side by fuel amount increasing correction, means 54 for comparing angular acceleration of the cylinder cyl_1 subjected to the fuel amount increasing correction or an average value thereof with angular acceleration of a cylinder cyl_n other than the cylinder cyl_1 having the largest variation of angular acceleration or an average value thereof, and means 55 for judging, when angular acceleration of the cylinder cyl_1 having the largest variation of angular acceleration or an average value thereof is greater than angular acceleration of cylinder cyl_n other than the cylinder cyl_1 having the largest variation of angular acceleration or an average value thereof, that the amount of air of the cylinder cyl_1 having the largest variation of angular acceleration is greater than the amount of air of the cylinder cyl_n other than the cylinder cyl_1 having the largest variation of angular acceleration.

That is, in the scheme according to the first aspect, the lean cylinder cyl_1 having the largest variation of angular acceleration is corrected with an increase of the amount of fuel, and angular acceleration of the lean cylinder cyl_1 or an average value thereof is then compared with angular acceleration of the cylinder cyl_n other than the cylinder cyl_1 or an average value thereof again.

In this case, if the cause for the leanness of the lean cylinder cyl_1 is an unintended increase of the amount of air, although the air-fuel ratio of the lean cylinder cyl_1 is modified (converged to the vicinity of the target air-fuel ratio) by fuel amount increasing correction, the amount of fuel supplied increases compared to that of the cylinder cyl_n other than the lean cylinder cyl_1, and therefore the torque generated increases.

That is, angular acceleration generated upon combustion of the lean cylinder cyl_1 is greater than angular acceleration generated upon combustion of the cylinder cyl_n other than the lean cylinder cyl_1. Therefore, when angular acceleration of the lean cylinder cyl_1 or an average value thereof is greater than angular acceleration of the cylinder cyl_n other than the lean cylinder cyl_1 or an average value thereof, it can be judged that the amount of air of the lean cylinder cyl_1 is greater than the amount of air of the cylinder cyl_n other than the lean cylinder cyl_1.

A fifth aspect of the engine control apparatus according to the present invention, shown in FIG. 5, includes, in addition to the above described configuration, after correcting the air-fuel ratio of the cylinder cyl_1 having the largest variation of angular acceleration to the rich side by air amount decreasing correction, means 56 for comparing angular acceleration of the cylinder cyl_1 subjected to the air amount decreasing correction or an average value thereof with angular acceleration of the cylinder cyl_n other than the cylinder cyl_1 having the largest variation of angular acceleration or an average value thereof, and means 57 for judging, when angular acceleration of the cylinder cyl_1 having the largest variation of angular acceleration or an average value thereof is smaller than angular acceleration of the cylinder cyl_n other than the cylinder cyl_1 having the largest variation of angular acceleration or an average value thereof, that the amount of fuel of the cylinder cyl_1 having the largest variation of angular acceleration is smaller than the amount of fuel of the cylinder cyl_n other than the cylinder cyl_1 having the largest variation of angular acceleration.

That is, the lean cylinder cyl_1 is corrected with a decrease in the amount of air under the scheme according to the first aspect and angular acceleration of the lean cylinder cyl_1 or an average value thereof is then compared with angular acceleration of the cylinder cyl_n other than the lean cylinder cyl_1 or an average value thereof.

In this case, if the cause for the leanness of the lean cylinder cyl_1 is an unintended decrease of the amount of fuel, although the air-fuel ratio of the lean cylinder cyl_1 is modified (converged to the vicinity of the target air-fuel ratio) by air amount decreasing correction, the amount of fuel supplied is smaller than that of the cylinder cyl_n other than the lean cylinder cyl_1, and therefore the torque generated of the lean cylinder cyl_1 decreases.

That is, angular acceleration generated upon combustion of the lean cylinder cyl_1 is smaller than angular acceleration generated upon combustion of the cylinder cyl_n other than the lean cylinder cyl_1. Therefore, when angular acceleration of the lean cylinder cyl_1 or an average value thereof is smaller than angular acceleration of the cylinder cyl_n other than the lean cylinder cyl_1 or an average value thereof, it can be judged that the amount of fuel of the lean cylinder cyl_1 is smaller than the amount of fuel of the cylinder cyl_n other than the lean cylinder cyl_1.

A sixth aspect of the engine control apparatus according to the present invention (FIG. 6) includes, in addition to the above described configuration, after correcting the air-fuel ratio of the cylinder cyl_n other than the cylinder cyl_1 having the largest variation of angular acceleration to the lean side by fuel amount decreasing correction, means 58 for comparing angular acceleration of the cylinder cyl_1 having the largest variation of angular acceleration or an average value thereof with angular acceleration of the cylinder cyl_n other than the cylinder cyl_1 having the largest variation of angular acceleration or an average value thereof, and means 59 for judging, when angular acceleration of the cylinder cyl_1 having the largest variation of angular acceleration or an average value thereof is greater than angular acceleration of the cylinder cyl_n other than the cylinder cyl_1 having the largest variation of angular acceleration or an average value thereof, that the amount of air of the cylinder cyl_1 having the largest variation of angular acceleration is greater than the amount of air of the cylinder cyl_n other than the cylinder cyl_1 having the largest variation of angular acceleration.

That is, after the cylinder cyl_n other than the lean cylinder cyl_1 is corrected by decreasing the amount of fuel under the scheme according to the first aspect, angular acceleration of the lean cylinder cyl_1 or an average value thereof is compared with angular acceleration of the cylinder cyl_n other than the lean cylinder cyl_1 or an average value thereof again.

In this case, if the cause for the leanness of the lean cylinder cyl_1 is an unintended increase of the amount of air, performing fuel amount decreasing correction on the cylinder cyl_n other than the lean cylinder cyl_1 causes the function to operate through air-fuel ratio feedback control whereby fuel amounts of all the cylinders are corrected so as to uniformly increase (to the rich side), and the air-fuel ratio of the lean cylinder cyl_1 is also thereby corrected and modified to the rich side (converged to the vicinity of the target air-fuel ratio).

However, as a result, since the lean cylinder cyl_1 has a greater amount of fuel supplied than that of the cylinder cyl_n other than the lean cylinder cyl_1, the torque generated increases. That is, angular acceleration generated upon combustion of the lean cylinder cyl_1 is greater than angular acceleration generated upon combustion of the cylinder cyl_n other than the lean cylinder cyl_1.

Therefore, when angular acceleration of the lean cylinder cyl_1 or an average value thereof is greater than angular acceleration of the cylinder cyl_n other than the lean cylinder cyl_1 or an average value thereof, it can be judged that the amount of air of the lean cylinder cyl_1 is greater than the amount of air of the cylinder cyl_n other than the lean cylinder cyl_1.

A seventh aspect of the engine control apparatus according to the present invention (FIG. 7) includes, in addition to the above described configuration, after correcting the air-fuel ratio of the cylinder cyl_n other than the cylinder cyl_1 having the largest variation of angular acceleration to the lean side by air amount increasing correction, means 60 for comparing angular acceleration of the cylinder cyl_1 having the largest variation of angular acceleration or an average value thereof with angular acceleration of the cylinder cyl_n other than the cylinder cyl_1 having the largest variation of angular acceleration or an average value thereof, and means 61 for judging, when angular acceleration of the cylinder cyl_1 having the largest variation of angular acceleration or an average value thereof is smaller than angular acceleration of the cylinder cyl_n other than the cylinder cyl_1 having the largest variation of angular acceleration or an average value thereof, that the amount of fuel of the cylinder cyl_1 having the largest variation of angular acceleration is smaller than the amount of fuel of the cylinder cyl_n other than the cylinder cyl_1 having the largest variation of angular acceleration.

That is, after the cylinder cyl_n other than the lean cylinder cyl_1 is corrected by air amount increasing correction under the scheme according to the first aspect, angular acceleration of the lean cylinder cyl_1 or an average value thereof is compared with angular acceleration of the cylinder cyl_n other than the lean cylinder cyl_1 or an average value thereof again.

In this case, if the cause for the leanness of the lean cylinder cyl_1 is an unintended decrease of the amount of fuel, performing fuel amount increasing correction on the cylinder cyl_n other than the lean cylinder cyl_1 causes the function to operate through air-fuel ratio feedback control whereby fuel amounts of all the cylinders are corrected so as to uniformly increase (to the rich side), and the air-fuel ratio of the lean cylinder cyl_1 is also thereby corrected and modified to the rich side (converged to the vicinity of the target air-fuel ratio).

However, since the lean cylinder cyl_1 still has a smaller amount of fuel supplied than that of the cylinder cyl_n other than the lean cylinder cyl_1, the torque generated is smaller. That is, angular acceleration generated upon combustion of the lean cylinder cyl_1 is smaller than angular acceleration generated upon combustion of the cylinder cyl_n other than the lean cylinder cyl_1.

Therefore, when angular acceleration of the lean cylinder cyl_1 or an average value thereof is smaller than angular acceleration of the cylinder cyl_n other than the lean cylinder cyl_1 or an average value thereof, it can be judged that the amount of fuel of the lean cylinder cyl_1 is smaller than the amount of fuel of the cylinder cyl_n other than the lean cylinder cyl_1.

An eighth aspect of the engine control apparatus according to the present invention includes, in addition to the configuration of the fourth aspect or sixth aspect, means for correcting (decreasing) the amount of air and amount of fuel of the cylinder cyl_1 (which is judged to have the greater amount of air). (See FIG. 8.)

That is, in the fourth aspect or sixth aspect, to eliminate the difference between the torque generated of the lean cylinder cyl_1 judged to have the greater amount of air and the torque generated of the cylinder cyl_n other than the lean cylinder cyl_1, correction is made so as to reduce the amount of air of the lean cylinder cyl_1 which is the cause of the difference. In this case, the amount of fuel is also reduced according to the decrease in the amount of air so that the air-fuel ratio of the lean cylinder cyl_1 does not become rich. As a result, there will be no more variations in the air-fuel ratio and torque between the lean cylinder cyl_1 and the cylinder cyl_n other than the lean cylinder cyl_1.

A ninth aspect of the engine control apparatus according to the present invention includes, in addition to the configuration of the fourth aspect or sixth aspect, means 63 for correcting (retarding) ignition timing of the cylinder cyl_1 (which is judged to have the greater amount of air). (See FIG. 9.)

That is, in the fourth aspect or sixth aspect, to eliminate the difference between the torque generated of the lean cylinder cyl_1 judged to have the greater amount of air and the torque generated of the cylinder cyl_n other than the lean cylinder cyl_1, ignition timing of the lean cylinder cyl_1 is corrected to the retarding side. As a result, there will be no more variations in the air-fuel ratio and torque between the lean cylinder cyl_1 and the cylinder cyl_n other than the lean cylinder cyl_1.

A tenth aspect of the engine control apparatus according to the present invention is shown in FIG. 10. In addition to the configuration of the fifth aspect or seventh aspect, it includes means 64 for correcting (increasing) the amount of air and amount of fuel of the cylinder cyl_1 (which is judged to have the smaller amount of fuel). (See FIG. 10.)

That is, in the fifth aspect or seventh aspect, to eliminate the difference between the torque generated of the lean cylinder cyl_1 judged to have the smaller amount of fuel and the torque generated of the cylinder cyl_n other than the lean cylinder cyl_1, correction is made so as to increase the amount of fuel of the lean cylinder cyl_1 which is the cause of the difference.

In this case, the amount of air is also increased according to the increase in the amount of fuel so that the air-fuel ratio of the lean cylinder cyl_1 does not become rich. As a result, there will be no more variations in the air-fuel ratio and torque between the lean cylinder cyl_1 and the cylinder cyl_n other than the lean cylinder cyl_1.

An eleventh aspect of the engine control apparatus according to the present invention (FIG. 11) includes, in addition to the configuration of the fifth aspect or seventh aspect, means 65 for correcting ignition timing of the cylinder cyl_1 judged to have the smaller amount of fuel to an advance angle side.

That is, in the fifth aspect or seventh aspect, to eliminate the difference between the torque generated of the lean cylinder cyl_1 judged to have the smaller amount of fuel and the torque generated of the cylinder cyl_n other than the lean cylinder cyl_1, ignition timing of the lean cylinder cyl_1 is corrected to an advance angle side. As a result, there will be no more variations in the air-fuel ratio and torque between the lean cylinder cyl_1 and the cylinder cyl_n other than the lean cylinder cyl_1.

A twelfth aspect of the engine control apparatus according to the present invention, as shown in FIG. 12, includes, in addition to the above described configuration, means 66 for calculating an average value of angular acceleration of each cylinder and means 67 for comparing an angular acceleration average value of a cylinder having the largest variation of angular acceleration with an average value of a cylinder other than the cylinder having the largest variation of angular acceleration and, when the angular acceleration average value of the cylinder having the largest variation of angular acceleration is smallest compared to the average value of the other cylinder, correcting (increasing) the amount of fuel of the cylinder having the largest variation of angular acceleration.

That is, as described above, the cylinder having a greater variation of angular acceleration is judged to be a lean cylinder. In this case, an average value of angular acceleration per cylinder is calculated simultaneously. If leanness is caused by an unexpected decrease of the amount of fuel, torque of the cylinder decreases, and therefore the angular acceleration average value of the cylinder in question becomes smaller than the angular acceleration average value of the other cylinder.

On the other hand, if leanness is caused by an unexpected increase of the amount of air, torque of the cylinder in question (since the amount of fuel has not decreased) hardly decreases, and therefore the angular acceleration average value of the cylinder in question hardly decreases compared to the angular acceleration average value of the other cylinder either.

Therefore, it is possible to resolve both leaning of the air-fuel ratio and torque reduction of the cylinder by increasing the amount of fuel of the cylinder in question when the angular acceleration average value of the cylinder having the largest variation of angular acceleration is smallest compared to the average value of the other cylinder.

A thirteenth aspect of the engine control apparatus according to the present invention (FIG. 13) includes, in addition to the configurations of the first to third aspects, and the eighth to eleventh aspects, means 68 for correcting the amount of air, amount of fuel and ignition timing so as to decrease the difference between angular acceleration of the cylinder cyl_1 having the largest variation of angular acceleration or an average value thereof and angular acceleration of the cylinder cyl_n other than the cylinder cyl_1 having the largest variation of angular acceleration or an average value thereof.

That is, in the first to third aspects, and the eighth to eleventh aspects, the difference between the torque generated of the cylinder cyl_1 having the large variation of angular acceleration and the torque generated of the cylinder cyl_n other the than cylinder cyl_1 having the largest variation of angular acceleration is detected from the difference between angular acceleration of the cylinder cyl_1 having the large variation of angular acceleration or an average value thereof and angular acceleration of the cylinder cyl_n other than the cylinder cyl_1 having the largest variation of angular acceleration or an average value thereof and the amount of air, amount of fuel and ignition timing are corrected so as to decrease the difference (until the difference falls to or below a predetermined value).

The present invention appropriately corrects errors in the fuel system and the air system in a mechanism in which the amount of fuel and the amount of air are controlled independently of each other and corrects variations in both the air-fuel ratio and torque, and can thereby stably operate the engine also in a real environment and thereby realize stable exhaust performance and fuel consumption performance ($CO_2$ performance).

DESCRIPTION OF SYMBOLS

Figure 1:
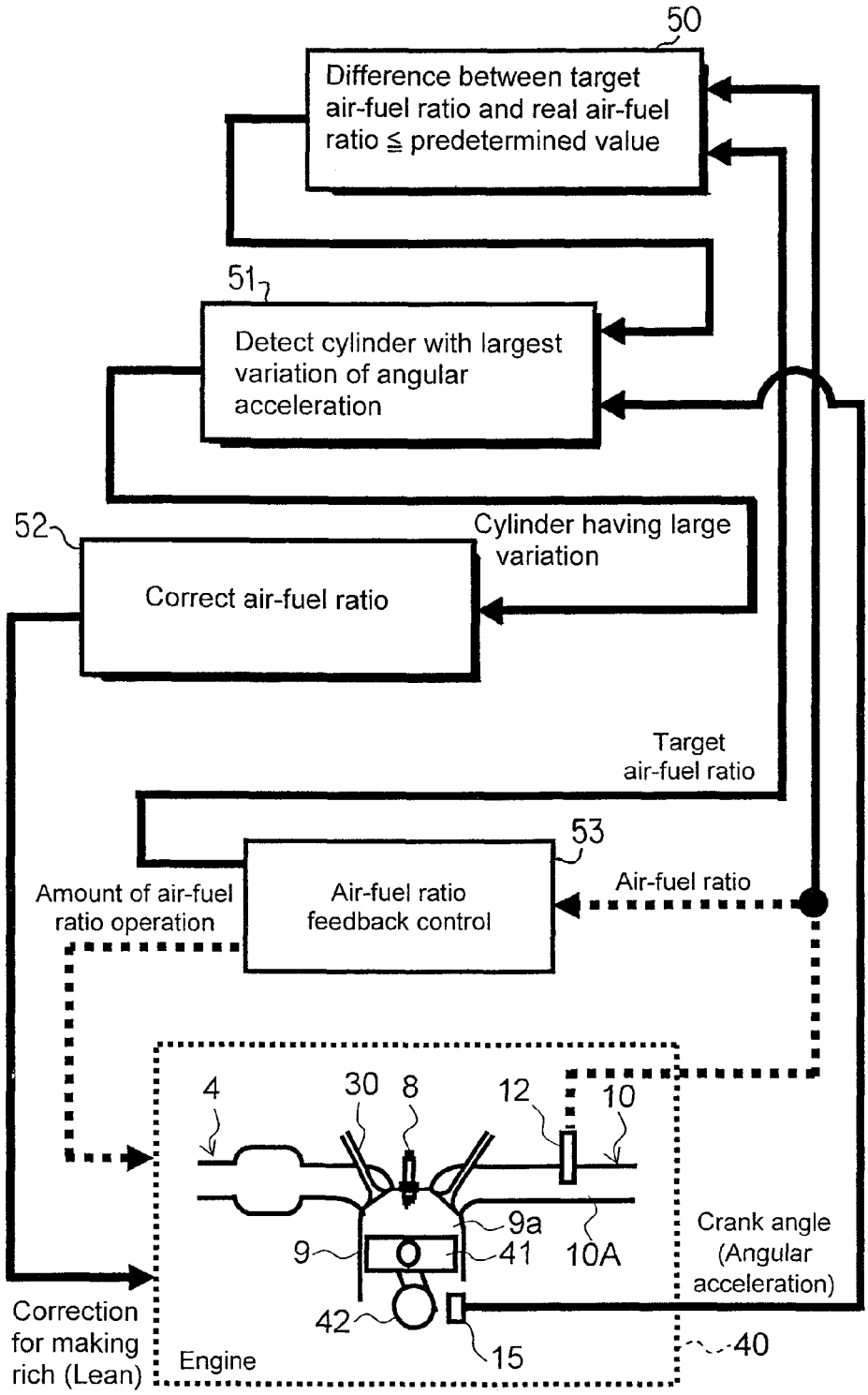
FIG. 1 is a diagram illustrating a first aspect of a control apparatus according to the present invention.
Figure 2:
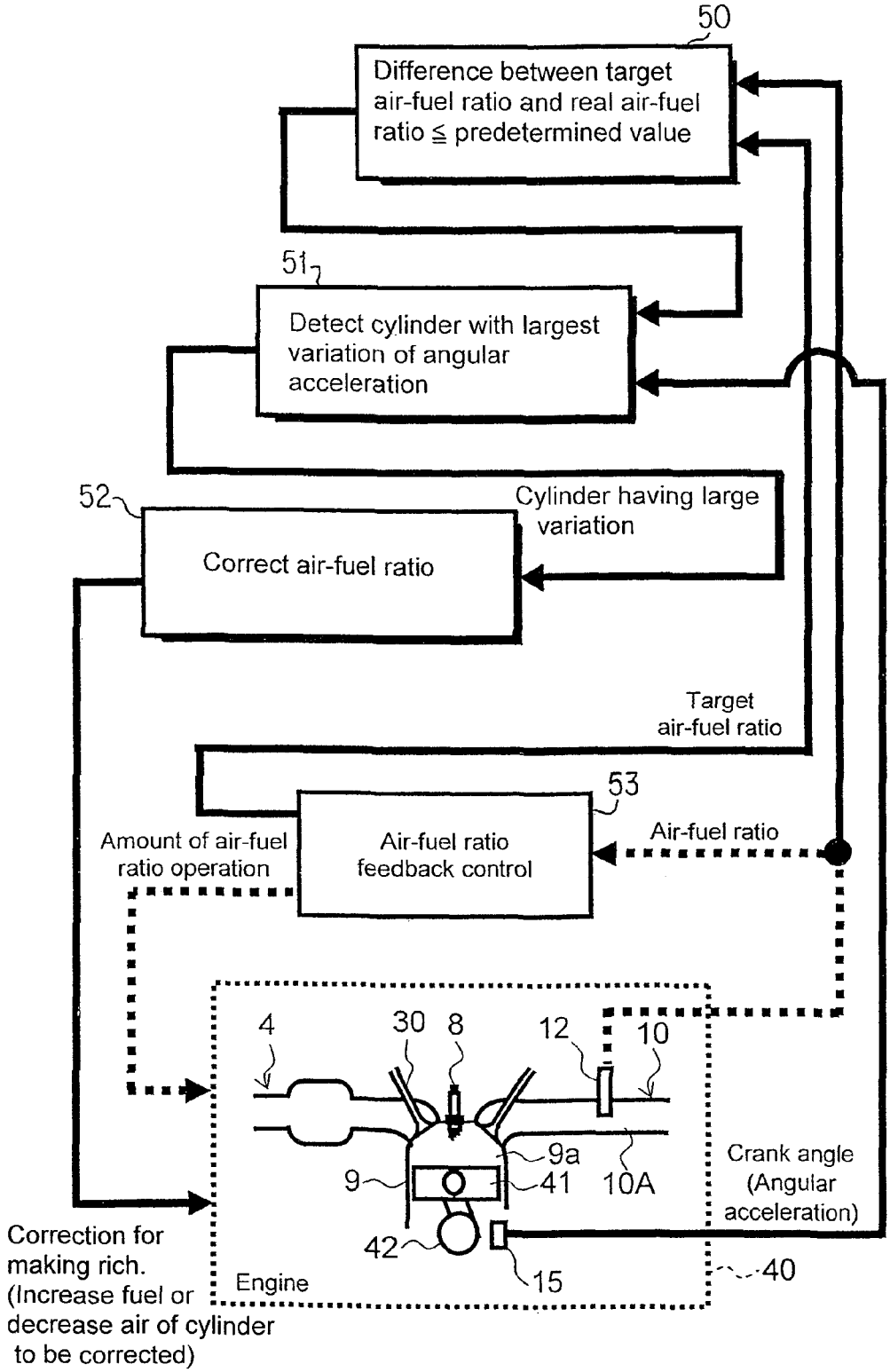
FIG. 2 is a diagram illustrating a second aspect of the control apparatus according to the present invention.
Figure 3:
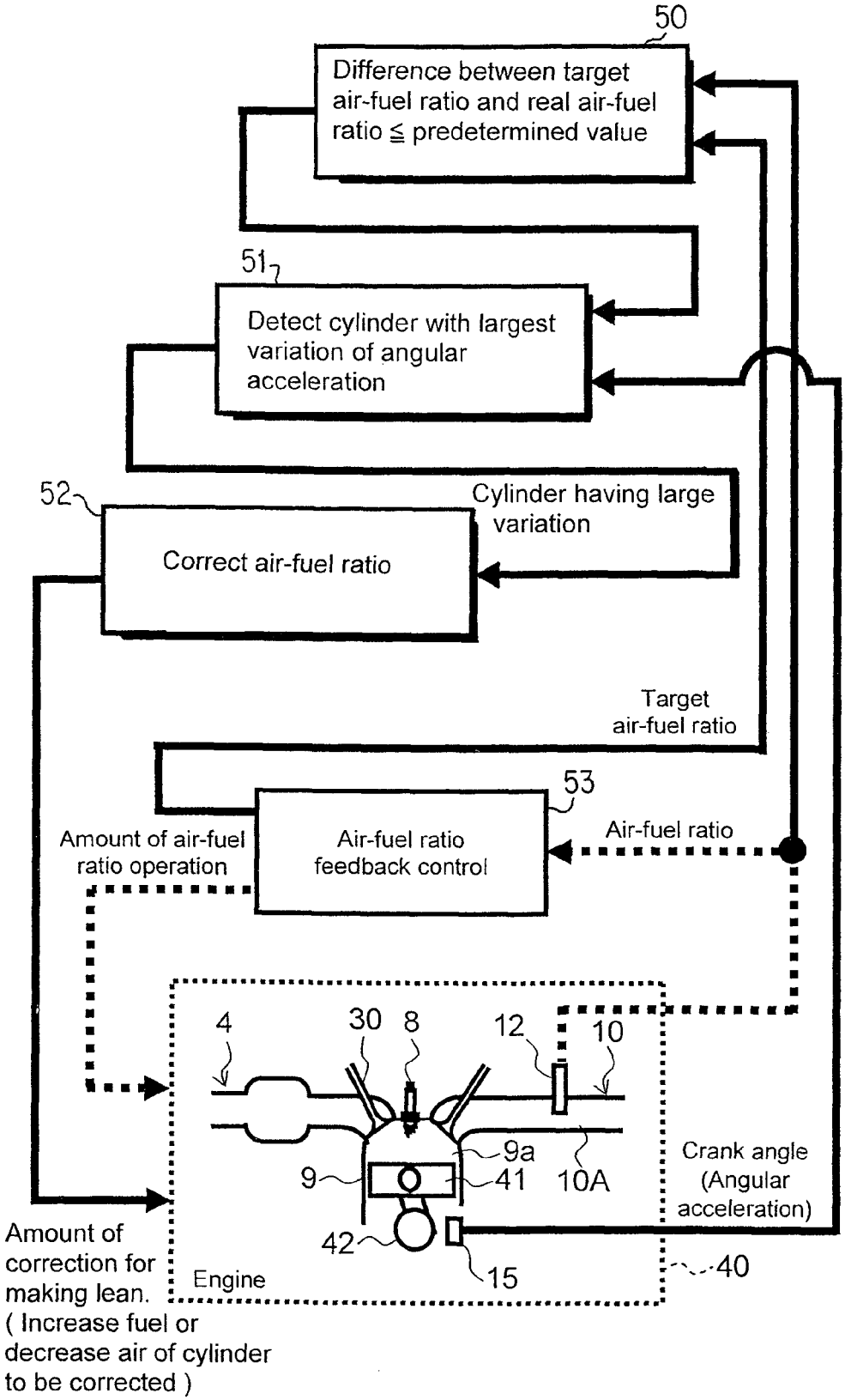
FIG. 3 is a diagram illustrating a third aspect of the control apparatus according to the present invention.
Figure 4:
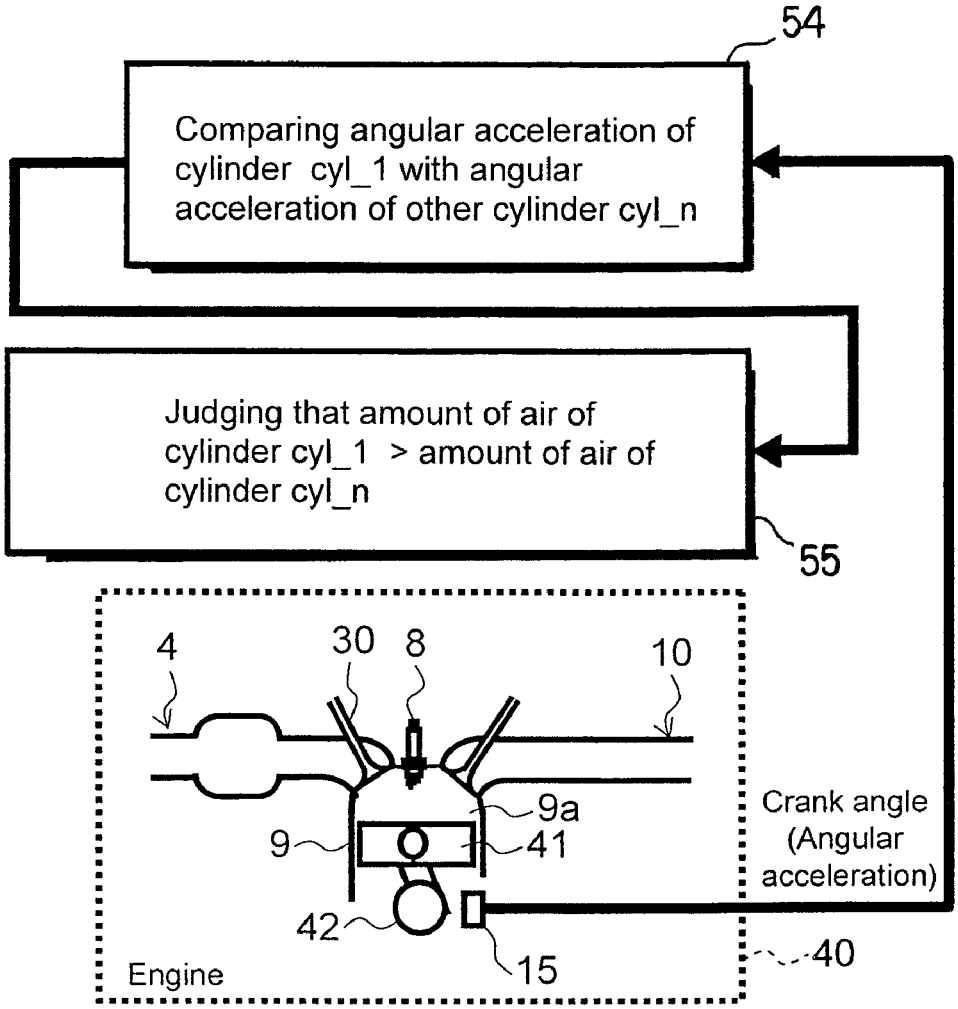
FIG. 4 is a diagram illustrating a fourth aspect of the control apparatus according to the present invention.
Figure 5:
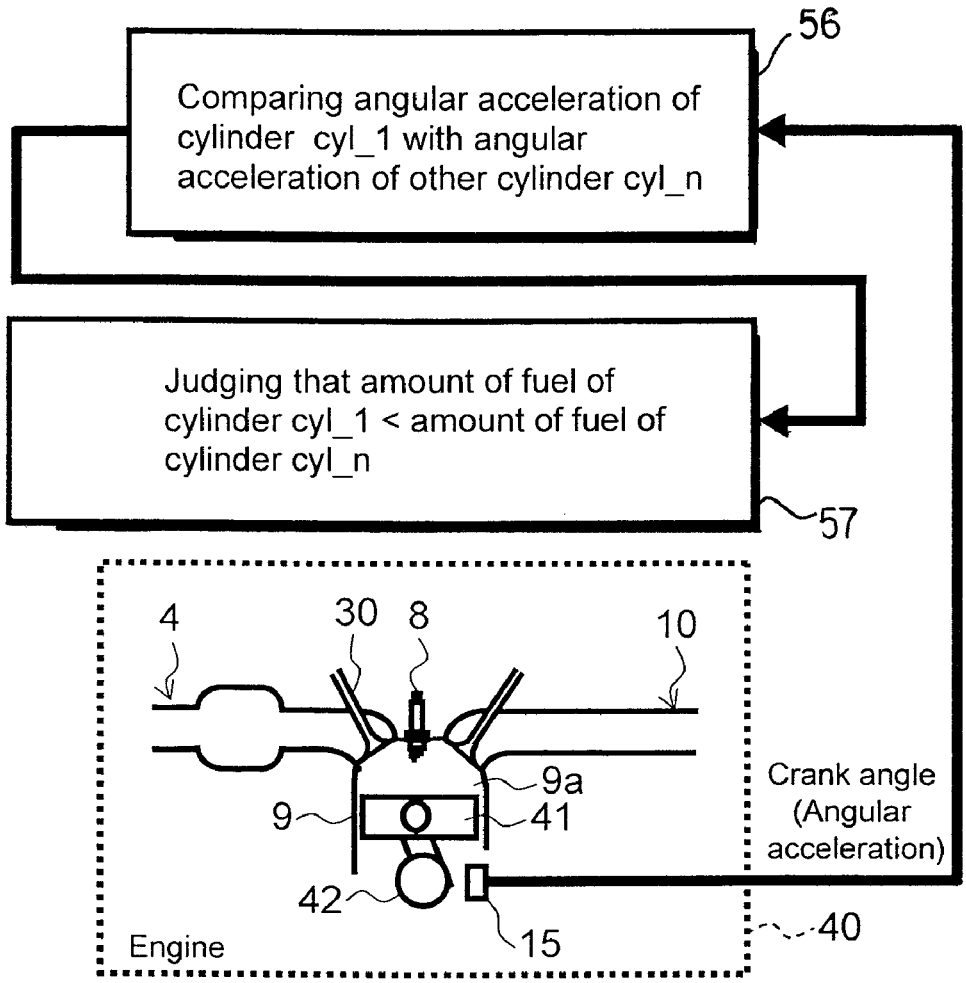
FIG. 5 is a diagram illustrating a fifth aspect of the control apparatus according to the present invention.
Figure 6:
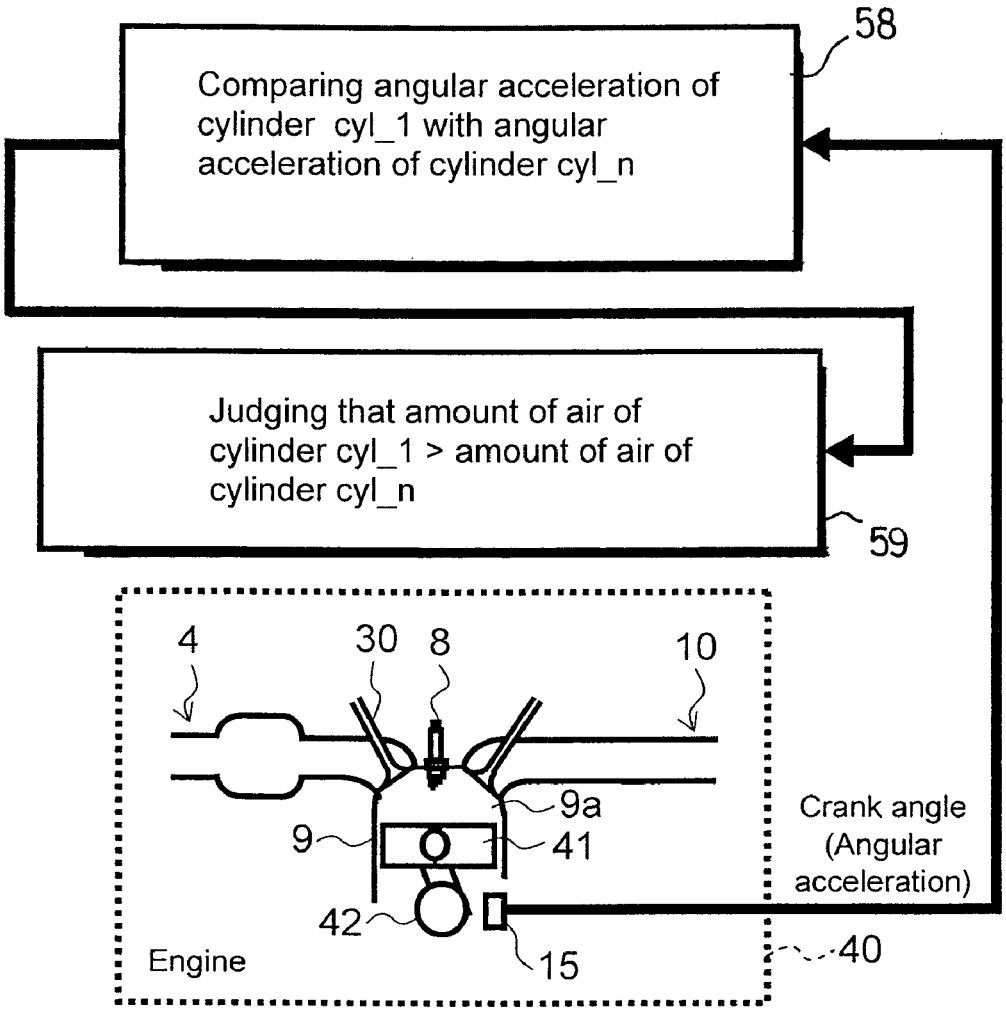
FIG. 6 is a diagram illustrating a sixth aspect of the control apparatus according to the present invention.
Figure 7:
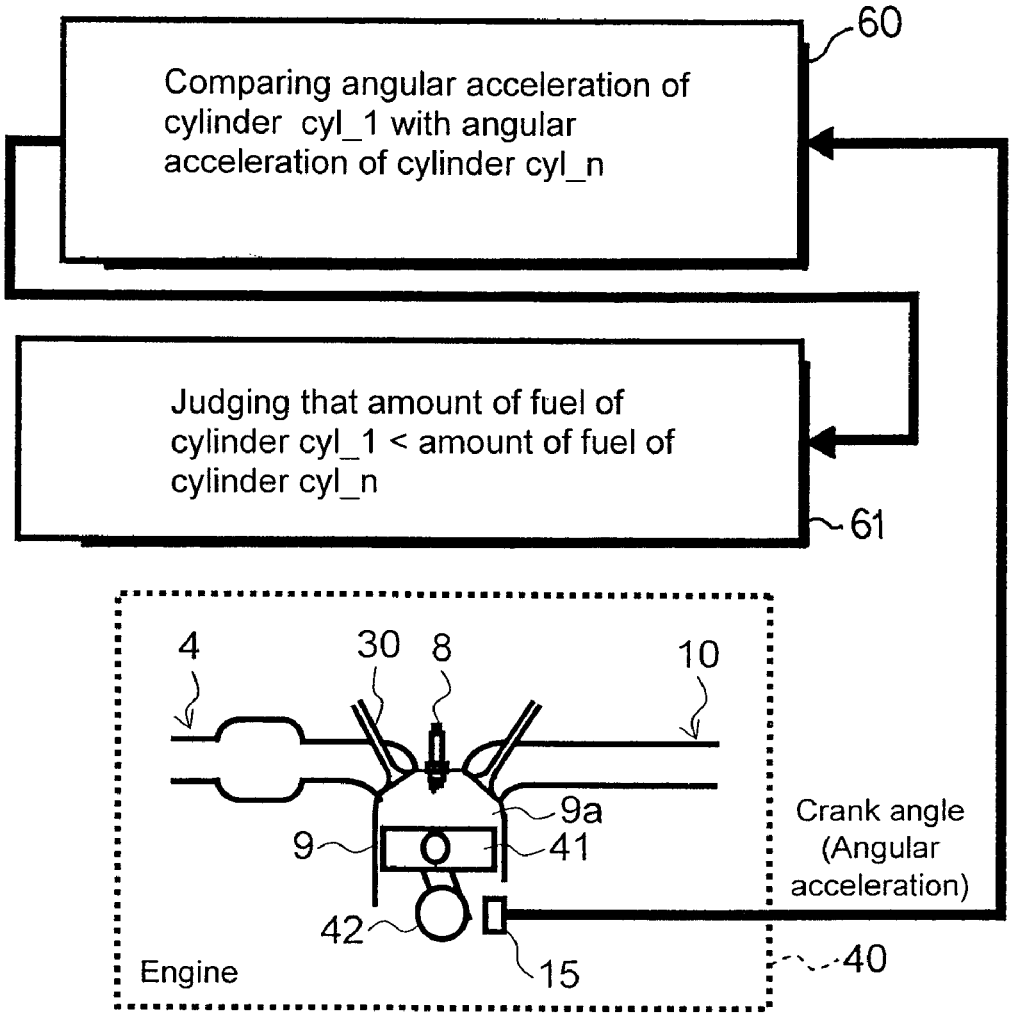
FIG. 7 is a diagram illustrating a seventh aspect of the control apparatus according to the present invention.
Figure 8:
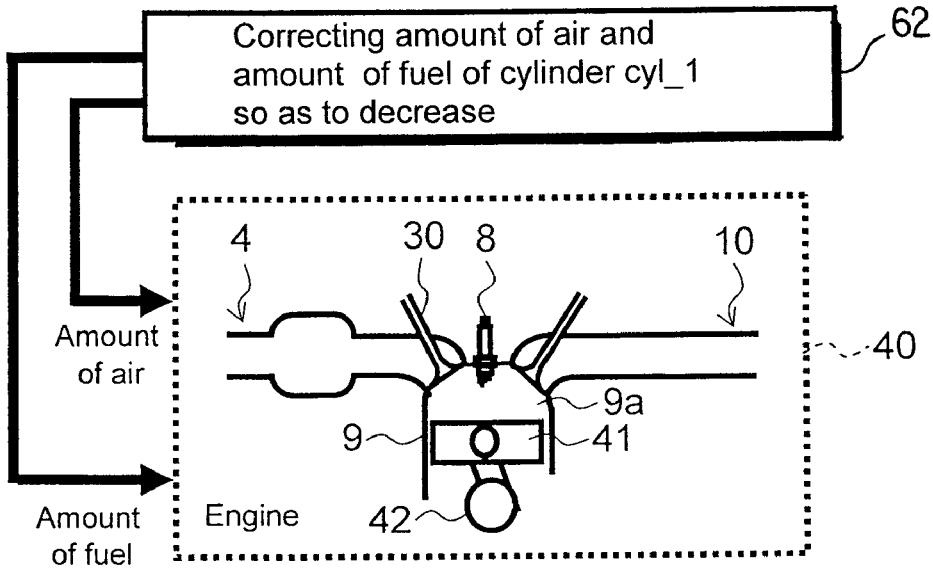
FIG. 8 is a diagram illustrating an eighth aspect of the control apparatus according to the present invention.
Figure 9:
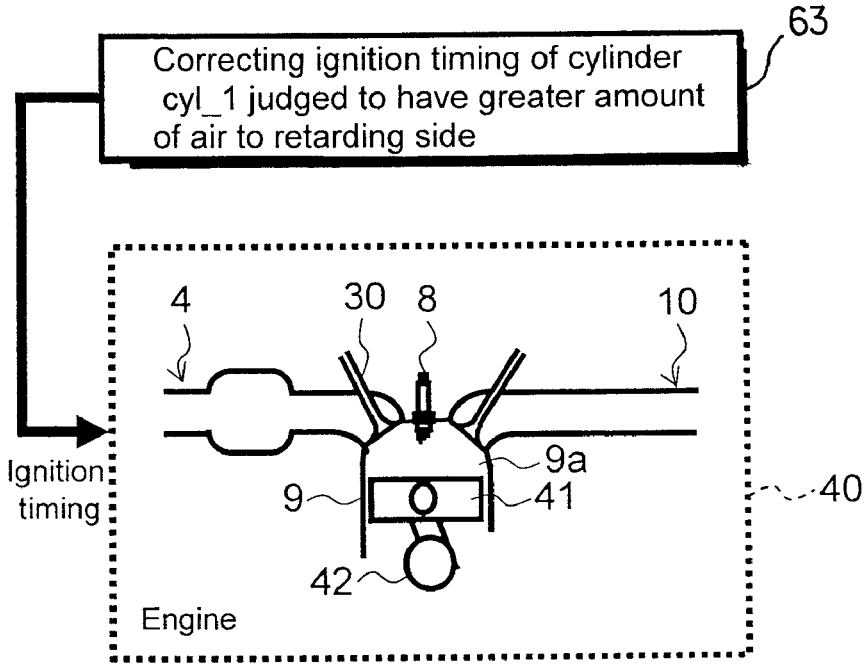
FIG. 9 is a diagram illustrating a ninth aspect of the control apparatus according to the present invention.
Figure 10:
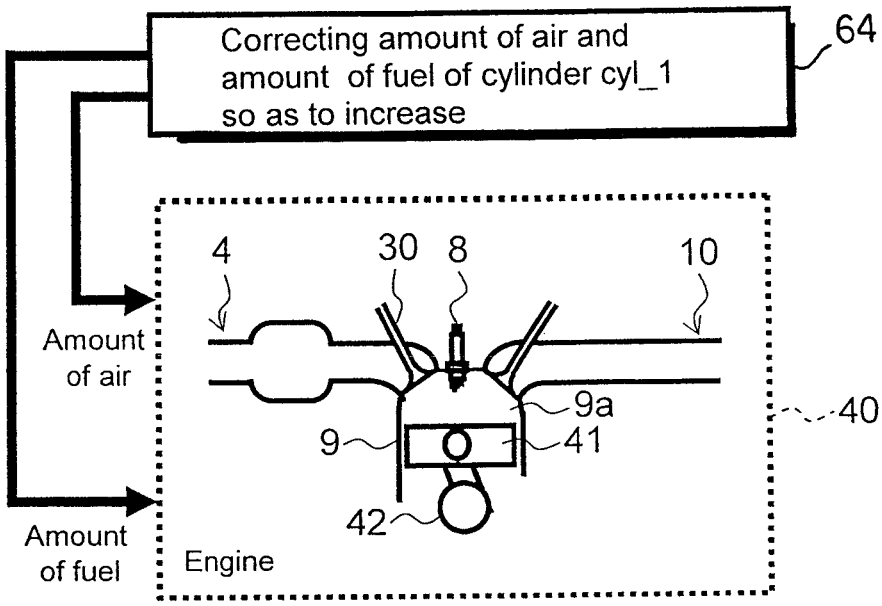
FIG. 10 is a diagram illustrating a tenth aspect of the control apparatus according to the present invention.
Figure 11:
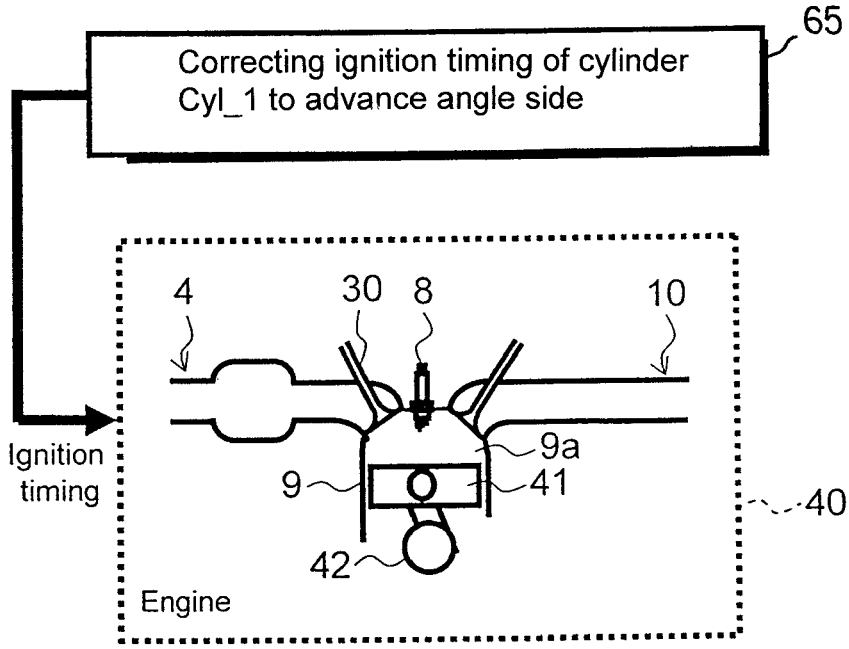
FIG. 11 is a diagram illustrating an eleventh aspect of the control apparatus according to the present invention.
Figure 12:
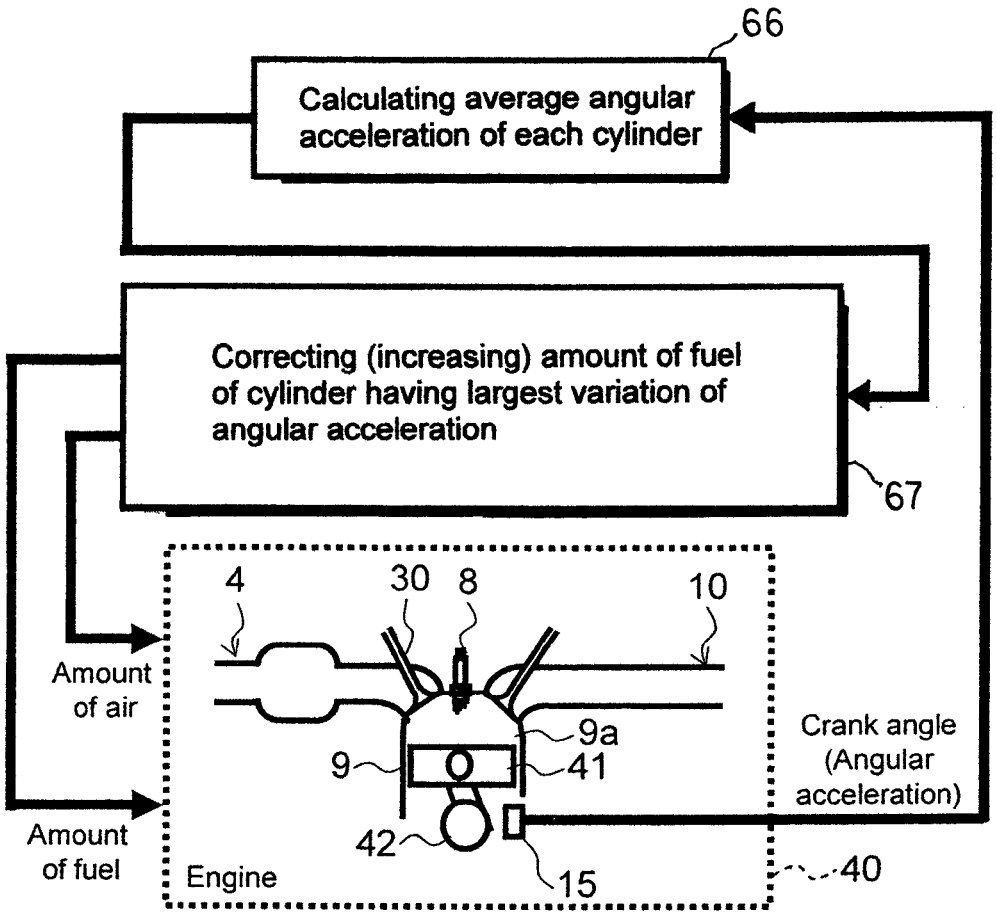
FIG. 12 is a diagram illustrating a twelfth aspect of the control apparatus according to the present invention.
Figure 13:
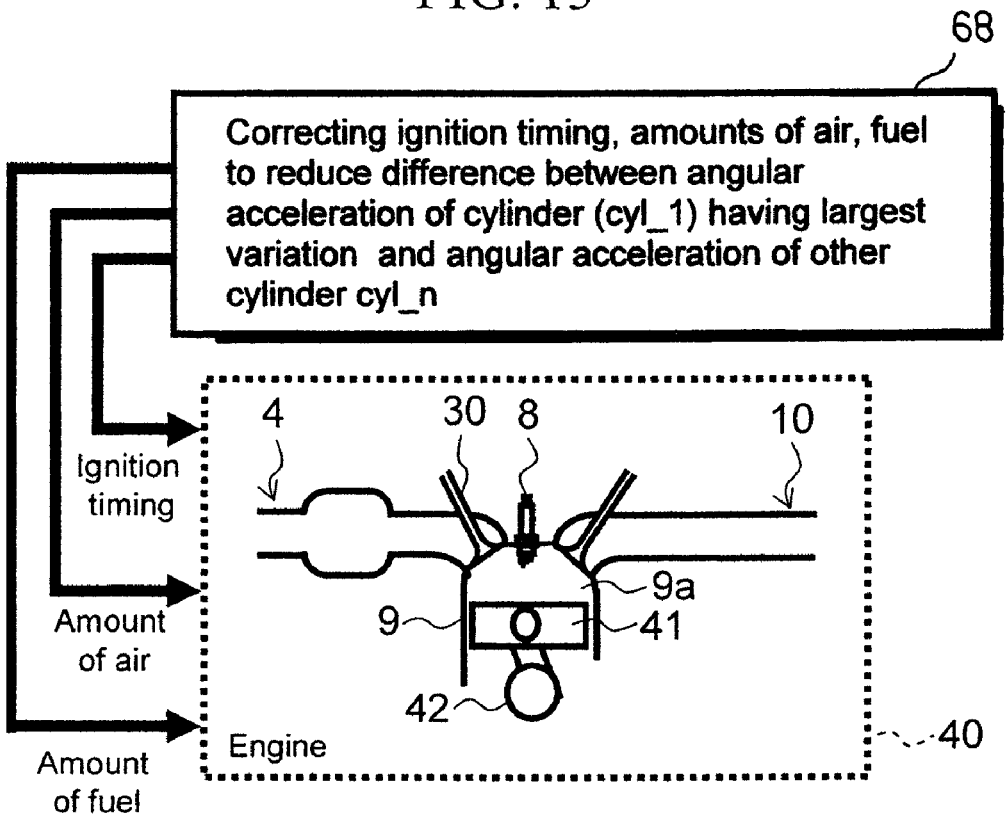
FIG. 13 is a diagram illustrating a thirteenth aspect of the control apparatus according to the present invention.

1 Air cleaner
2 Air flow sensor
3 Electronic throttle
4 Intake passage
5 Collector
6 Accelerator
7 Fuel injection valve
8 Ignition plug
9 Engine
10 Exhaust passage
11 Three-way catalyst
12 A/F sensor
13 Accelerator opening degree sensor
14 Water temperature sensor
15 Engine speed sensor
16 Control unit
17 Throttle opening degree sensor
18 Exhaust recirculation pipe
19 Exhaust recirculation rate control valve
20 Catalyst downstream $O_2$ sensor
21 CPU mounted in control unit
22 ROM mounted in control unit
23 RAM mounted in control unit
24 Input circuit of sensors mounted in control unit
25 Port to input sensor signals and output actuator operation signals
26 Ignition output circuit that outputs drive signal to ignition plug at appropriate timing
27 Fuel injection valve drive circuit that outputs appropriate pulse to fuel injection valve
28 Electronic throttle drive circuit
29 Intake temperature sensor
30 Intake variable valve
31 Vehicle speed sensor
32 Intake variable valve drive circuit

DETAILED DESCRIPTION OF THE PREFERRED EMBODIMENTS

Hereinafter, embodiments of the present invention will be described with reference to the accompanying drawings.

Figure 14:
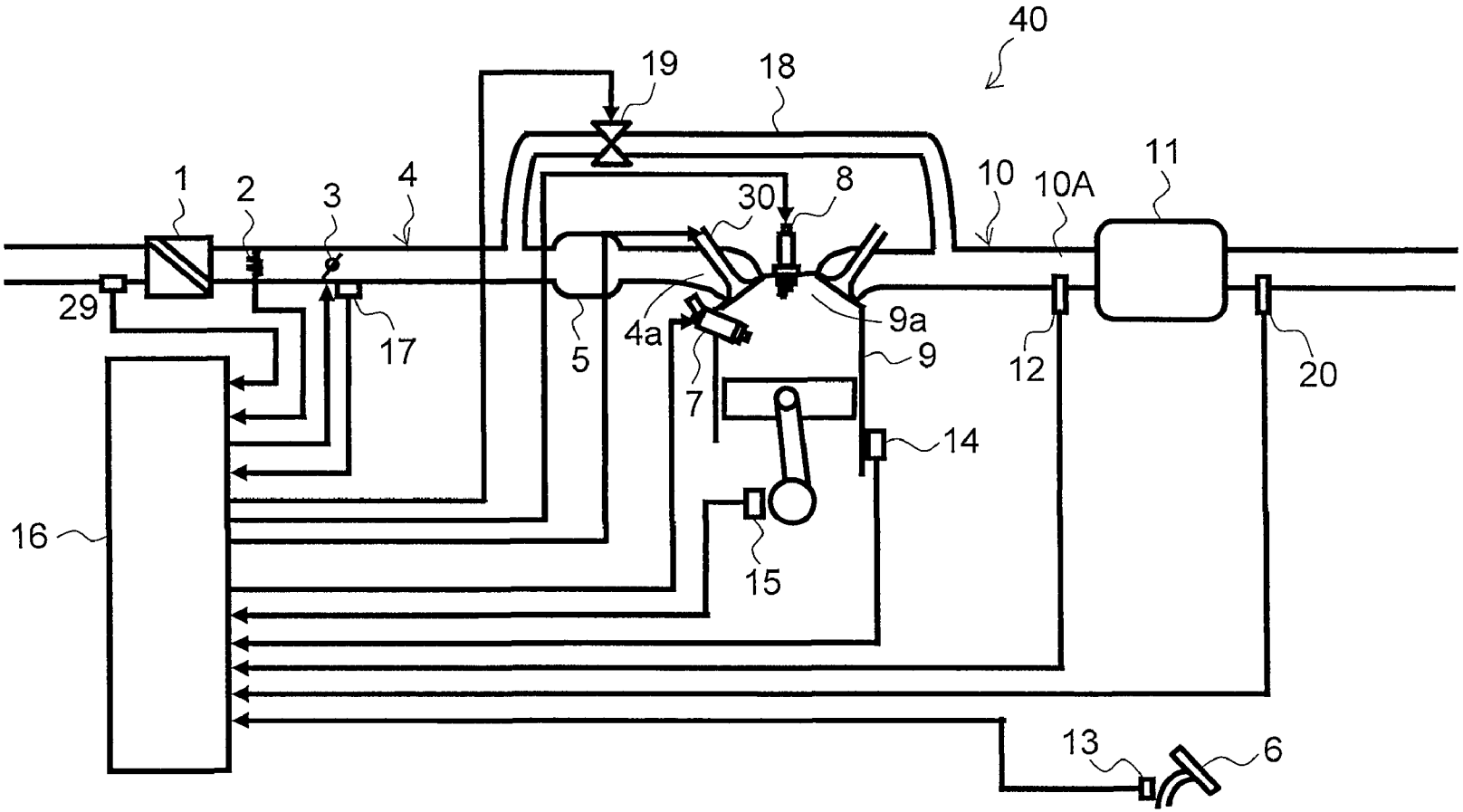
FIG. 14 is a schematic configuration diagram illustrating an embodiment of the control apparatus according to the present invention together with an engine to which the present invention is applied.

FIG. 14 is a schematic configuration diagram illustrating an embodiment (common to Embodiments 1 to 8) of an engine control apparatus according to the present invention together with a vehicle-mounted engine to which the present invention is applied.

The engine 40 is an in-cylinder injection engine made up of a plurality of cylinders 9 (here, 4 cylinders) and air from the outside passes through an air cleaner 1, an intake passage 4 and a collector 5, distributed to a branch passage making up a downstream section of the intake passage 4 and flows into a combustion chamber 9*a* of each cylinder 9.

An intake variable valve 30 is disposed at an intake port 4*a* at a downstream end of the intake passage 4 to open/close between the intake passage 4 and the combustion chamber 9*a*. The amount of air inflow is detected by an air flow sensor 2 and controlled by an electronic throttle 3 and the intake variable valve 30.

The intake variable valve 30 is provided with a variable valve mechanism (not shown), driven based on a drive signal from an intake variable valve drive circuit 32 of an engine control unit 16 and configured to be able to adjust an amount of lift and opening/closing timing. The intake variable valve 30 can adjust the amount of air taken into each cylinder on a cylinder-by-cylinder basis.

A crank angle sensor 15 outputs a signal for each angle of rotation 10° (deg) of a crank shaft 42 and a signal for each combustion cycle. An intake temperature sensor 29 detects an intake temperature, a water temperature sensor 14 detects an engine cooling water temperature, an accelerator opening degree sensor 13 detects an amount of pressing down of an accelerator pedal 6 and thereby detects desired torque of the driver.

Signals from the accelerator opening degree sensor 13, air flow sensor 2, intake temperature sensor 29, throttle opening degree sensor 17 attached to the electronic throttle 3, crank angle sensor 15 and water temperature sensor 14 are sent to the engine control unit (ECU) 16, which is a control apparatus of the engine 40 according to the present embodiment and acquire operation conditions of the engine 40 from the respective sensor outputs and calculate optimal principal operation amounts of the engine 40 such as an amount of air, fuel injection amount and ignition timing.

The target amount of air calculated in the engine control unit 16 is converted from a target throttle opening degree to an electronic throttle drive signal and sent to the electronic throttle 3. The fuel injection amount is converted to an open valve pulse signal and sent to a fuel injection valve (injector) 7. The fuel injection valve 7 is provided in each cylinder 9 and injects fuel into the combustion chamber 9*a* based on an open valve pulse signal.

Furthermore, a drive signal for realizing ignition at ignition timing calculated by the engine control unit 16 is sent to an ignition plug 8. The ignition plug 8 is attached such that the ignition section faces the interior of the combustion chamber 9*a* of each cylinder 9.

The fuel injected from the fuel injection valve 7 is mixed with the air from the intake passage 4 and forms an air-fuel mixture in the combustion chamber 9*a*. The air-fuel mixture explodes with a spark generated from the ignition plug 8 at predetermined ignition timing and the combustion pressure thereof presses down a piston 41 in the cylinder 9, generating power of the engine 40.

The exhaust of each cylinder 9 is discharged into an individual passage forming an upstream section of an exhaust passage 10 via an exhaust port where an exhaust valve from the combustion chamber 9*a* is disposed, passes through an exhaust manifold 10A from the individual passage, flows into a three-way catalyst 11 provided in a downstream section of the exhaust passage 10, is cleaned by the three-way catalyst 11 and then discharged to the outside. The three-way catalyst 11 cleans the exhaust gas by oxidizing carbon hydride HC and carbon monoxide CO contained therein and reducing nitrogen oxide NOx.

A catalyst downstream $O_2$ sensor 20 is provided downstream of the three-way catalyst 11 in the exhaust passage 10 and a catalyst upstream A/F sensor 12 is provided as an exhaust sensor that detects the exhaust air-fuel ratio in the exhaust manifold 10A upstream of the catalyst 11 in the exhaust passage 10.

The catalyst upstream A/F sensor 12 has a linear output characteristic with respect to oxygen concentration contained in the exhaust. The oxygen concentration in the exhaust has a substantially linear relationship with the air-fuel ratio, which allows the catalyst upstream A/F sensor 12 that detects the oxygen concentration to calculate the exhaust air-fuel ratio.

The engine control unit 16 then calculates the exhaust air-fuel ratio upstream of the three-way catalyst 11 from the output signal of the catalyst upstream A/F sensor 12 and determines whether or not the exhaust is rich or lean with respect to the oxygen concentration or stoiciometry downstream of the three-way catalyst 11 based on the output signal of the catalyst downstream $O_2$ sensor 20.

Furthermore, the engine control unit 16 also performs FB control of successively correcting the fuel injection amount (amount of fuel injected) or amount of air using the outputs of the catalyst upstream A/F sensor 12 and catalyst downstream $O_2$ sensor 20 so that the cleaning efficiency of the three-way catalyst 11 becomes optimum.

Furthermore, part of the exhaust gas discharged from the combustion chamber 9*a* into the exhaust passage 10 flows back to the intake passage 4 side via an exhaust recirculation pipe 18 on an as-needed basis. This recirculation rate is controlled by an EGR valve 19 provided in the exhaust recirculation pipe 18.

Figure 15:
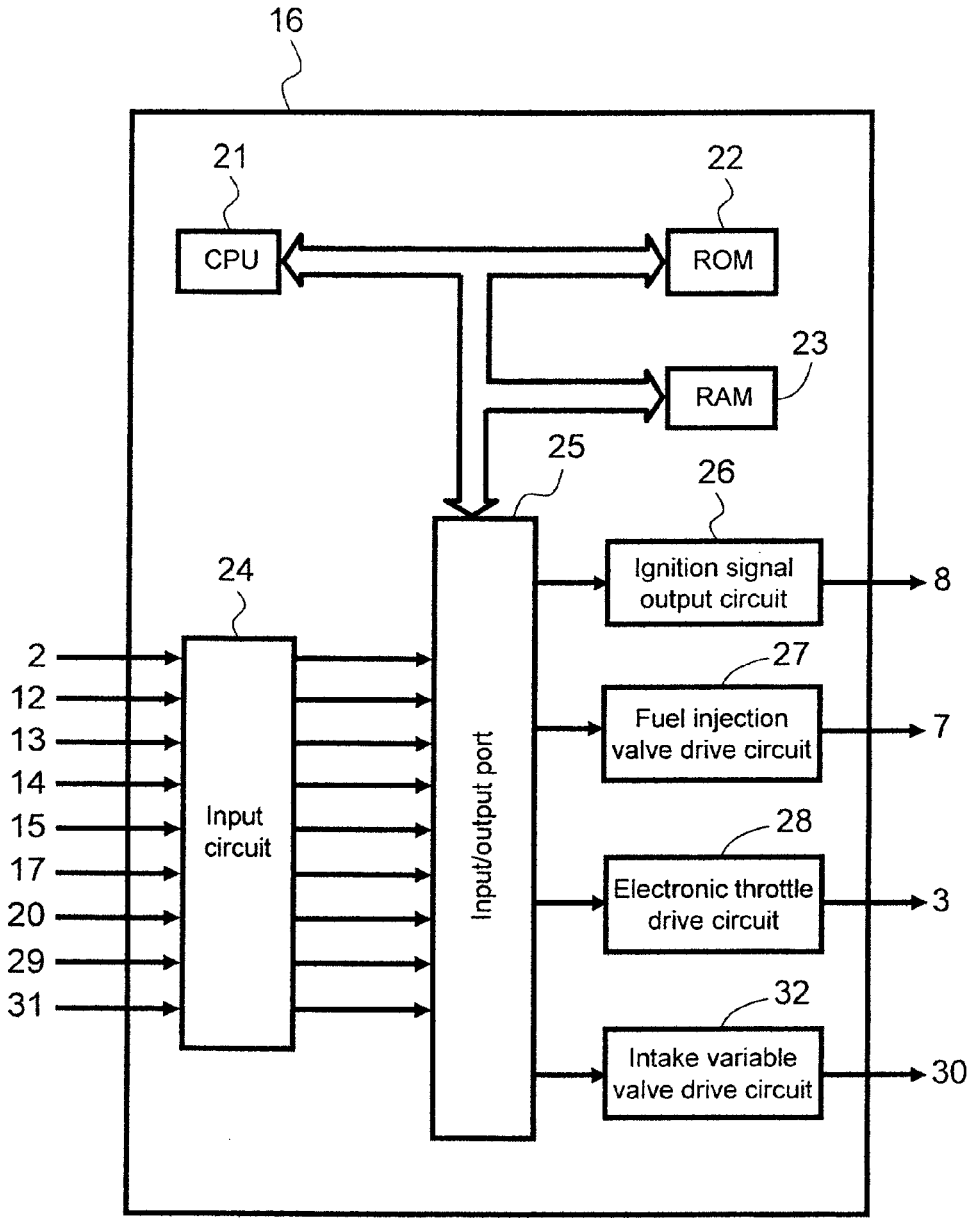
FIG. 15 is a diagram illustrating an internal configuration of the control unit shown in FIG. 14.

FIG. 15 is an internal configuration diagram of the engine control unit 16 (Embodiments 1 to 8). The ECU 16 receives sensor output values from the air flow sensor 2, catalyst upstream A/F sensor 12, accelerator opening degree sensor 13, water temperature sensor 14, engine speed sensor 15, throttle valve opening degree sensor 17, catalyst downstream $O_2$ sensor 20, intake temperature sensor 29 and vehicle speed sensor 31, and an input circuit 24 performs signal processing such as noise elimination and sends the signals to an input/output port 25.

The input port values are stored in a RAM 23 and subjected to calculation processing in a CPU 21. A control program describing contents of the calculation processing is written in a ROM 22 beforehand, and values indicating the amounts of respective actuator operations calculated according to the control program are stored in the RAM 23 and then sent to the input/output port 25.

For an operation signal of the ignition plug 8 used upon spark ignition/combustion, an ON/OFF signal is set which turns ON when a current flows into a primary coil in an ignition signal output circuit 26 and turns OFF when no current flows. The ignition timing is timing of changing from ON to OFF, and a signal for the ignition plug set at the output port is amplified to energy enough for combustion by the ignition signal output circuit 26 and supplied to the ignition plug 8.

Furthermore, for a drive signal of the fuel injection valve 7, an ON/OFF signal is set which turns ON when the valve is opened and turns OFF when the valve is closed, and is amplified to energy enough to open the fuel injection valve 7 by a fuel injection valve drive circuit 27 and outputted to the fuel injection valve 7. Furthermore, a drive signal for realizing a target opening degree of the electronic throttle 3 is outputted to the electronic throttle 3 via an electronic throttle drive circuit 28. Drive signals for realizing a target amount of lift and target opening/closing timing of the intake variable valve 30 are outputted to the intake variable valve 30 via the intake variable valve drive circuit 32.

Next, an embodiment of control exercised by the engine control unit 16 will be described more specifically.

[Embodiment 1: FIG. 16 to FIG. 22]

Figure 16:
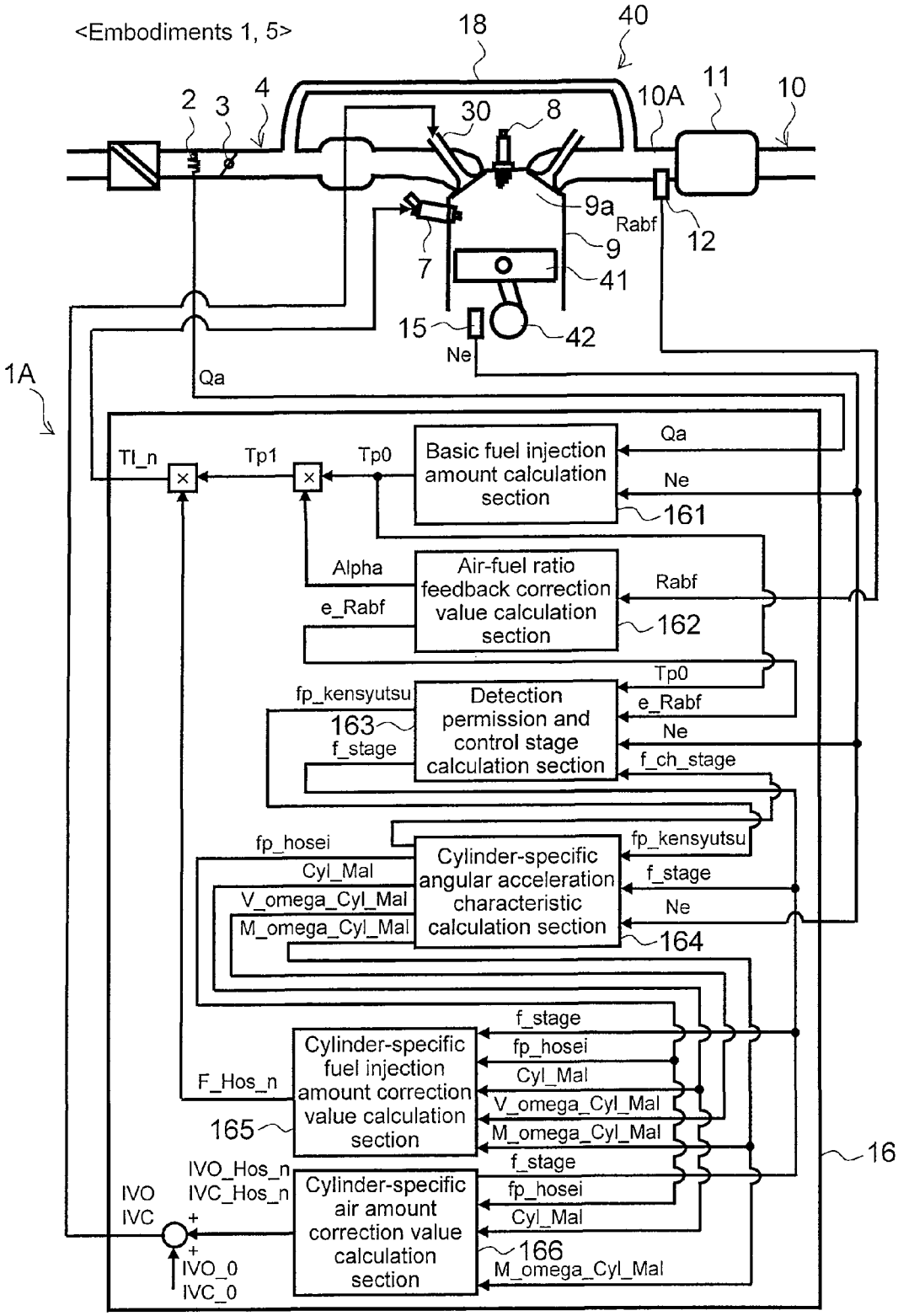
FIG. 16 is a control system diagram according to Embodiments 1 and 5.

FIG. 16 is a control system diagram illustrating a control apparatus 1A according to Embodiments 1, 5. As shown in the function block diagram, the engine control unit 16 of the control apparatus 1A is provided with a basic fuel injection amount calculation section 161, an air-fuel ratio feedback correction value calculation section 162, a detection permission and control stage calculation section 163, a cylinder-specific angular acceleration characteristic calculation section 164, a cylinder-specific fuel injection amount correction value calculation section 165 and a cylinder-specific air amount correction value calculation section 166. These calculation sections are realized by the engine control unit 16 executing a control program.

The basic fuel injection amount calculation section 161 calculates a basic fuel injection amount Tp0 based on an amount of intake air Qa and an engine speed Ne. The air-fuel ratio feedback correction value calculation section 162 calculates a correction value (Alpha) for equally correcting fuel injection amounts of all cylinders based on the output (Rabf) of the catalyst upstream A/F sensor 12 so that an exhaust manifold air-fuel ratio (Rabf) converges to a target air-fuel ratio and also calculates an error (e_Rabf) between the target air-fuel ratio and the exhaust manifold air-fuel ratio.

The detection permission and control stage calculation section 163 calculates a cylinder-specific angular acceleration characteristic detection permission flag (fp_kensyutsu) and control stage flag (f_stage) for performing cylinder-specific fuel injection amount correction and air amount correction. The control stage is made up of two stages; stage 1 and stage 2 (details will be described later).

When the detection permission and control stage calculation section 163 outputs detection permission (fp_kensyutsu=1), the cylinder-specific angular acceleration characteristic calculation section 164 calculates, according to the respective stages, a cylinder number of an abnormal cylinder (Cyl_Mal) which is a cylinder-specific angular acceleration characteristic, a variance of angular acceleration of an abnormal cylinder (V_omega_Cyl_Mal) and an average value of angular acceleration of the abnormal cylinder (M_omega_Cyl_Mal). After calculations of the above described cylinder-specific angular acceleration characteristics are completed, the cylinder-specific angular acceleration characteristic calculation section 164 calculates a flag (fp_hosei) for permitting corrections of the amount of fuel and amount of air.

The cylinder-specific fuel injection amount correction value calculation section 165 calculates a cylinder-specific fuel injection amount correction value (F_Hos_n (n is a cylinder number)) based on a control stage flag (f_stage) calculated by the aforementioned detection permission and control stage calculation section 163, the correction permission flag (fp_hosei) calculated by the cylinder-specific angular acceleration characteristic calculation section 164, the cylinder number (Cyl_Mal) of the abnormal cylinder, the variance (V_omega_Cyl_Mal) of angular acceleration of the abnormal cylinder and the average value (M_omega_Cyl_Mal) of angular acceleration of the abnormal cylinder.

The cylinder-specific air amount correction value calculation section 166 calculates a cylinder-specific air amount correction value (IVO_Hos_n, IVC_Hos_n) based on the control stage flag (f_stage) calculated by the aforementioned detection permission and control stage calculation section 163, the correction permission flag (fp_hosei) calculated by the cylinder-specific angular acceleration characteristic calculation section 164, the cylinder number (Cyl_Mal) of the abnormal cylinder and the average value of angular acceleration (M_omega_Cyl_Mal) of the abnormal cylinder.

Here, IVO_Hos_n is a correction value applied to intake valve opening timing (IVO_n) of an nth cylinder and IVC Hos_n is a correction value applied to intake valve closing timing (IVC_n) of the nth cylinder. There are various methods for calculating IVO_n and IVC_n, but since these methods are not directly related to the present invention, detailed descriptions thereof will be omitted here.

In Embodiment 1, the following processes will be controlled.

Stage 1 (when f_stage=1)

(1) A variance of angular acceleration is calculated for each cylinder and a cylinder having the largest variance of angular acceleration (leanest cylinder: lean cylinder) is detected as an abnormal cylinder (Cyl Mal). A variance of angular acceleration of the cylinder of cylinder number (Cyl_Mal), that is, the abnormal cylinder is assumed to be V_omega_Cyl_Mal.

(2) The fuel injection amount of the abnormal cylinder is corrected so as to increase (F_Hos_n) based on V_omega_Cyl_Mal.

Stage 2 (when f_stage=2)

(1) Performed after stage 1 ends.

(2) An average value of angular acceleration is calculated for each cylinder and when the cylinder number having the largest average value of angular acceleration matches cylinder number (Cyl_Mal) of the abnormal cylinder, the average value of angular acceleration of the abnormal cylinder is assumed to be M_omega_Cyl_Mal.

(3) The fuel injection amount and amount of air of the abnormal cylinder are corrected so as to decrease based on M_omega_Cyl_Mal (F_Hos_n, IVO_Hos_n, IVC_Hos_n).

Hereinafter, the respective calculation sections will be described in detail.

<Basic Fuel Injection Amount Calculation Section (FIG. 17)>

Figure 17:
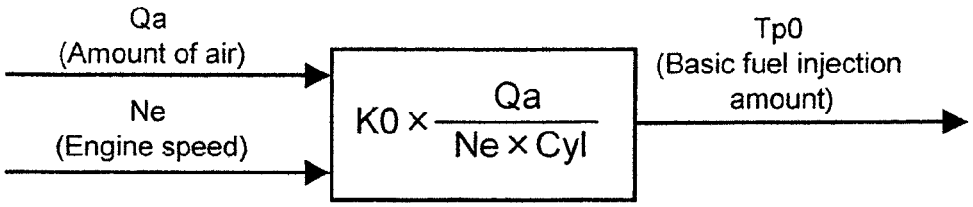
FIG. 17 is a diagram illustrating the basic fuel injection amount calculation section according to Embodiments 1 to 8.

FIG. 17 is a block diagram illustrating functions of the basic fuel injection amount calculation section (Embodiments 1 to 8).

The basic fuel injection amount calculation section 161 shown in FIG. 16 calculates a basic fuel injection amount (Tp0) based on the amount of intake air Qa and the engine speed Ne. To be more specific, the basic fuel injection amount is calculated using Expression (1) shown below.

$$Tp0=K0\times Qa/(Ne\times \mathrm{Cyl}) \quad (1)$$

Here, "Cyl" denotes the number of cylinders. "K0" is determined based on the specification of the injector (relationship between the fuel injection pulse width and the fuel injection amount).

<Air-fuel Ratio Feedback Correction Value Calculation Section (FIG. 18)>

Figure 18:
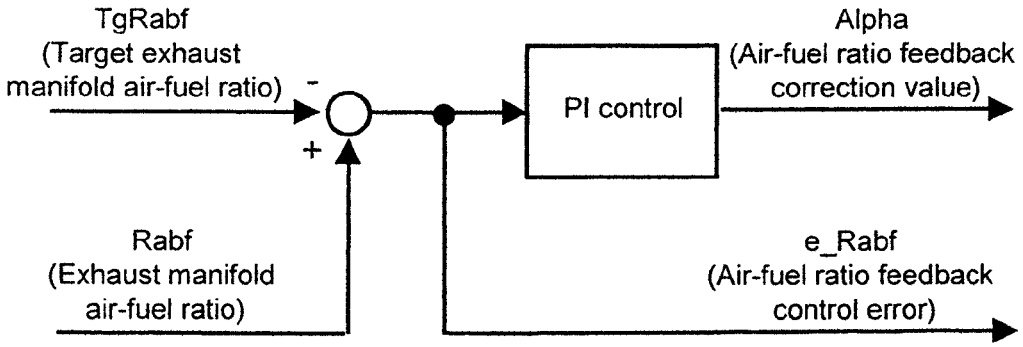
FIG. 18 is a diagram illustrating the air-fuel ratio feedback correction value calculation section according to Embodiments 1 to 8.

FIG. 18 is a block diagram illustrating functions of the air-fuel ratio feedback correction value calculation section (Embodiments 1 to 8).

The air-fuel ratio feedback correction value calculation section 162 shown in FIG. 16 calculates a fuel injection amount correction value based on the output (Rabf) of the air-fuel ratio sensor 12. To be more specific, as shown in FIG. 18, the air-fuel ratio feedback correction value calculation section 162 calculates an air-fuel ratio feedback correction value (Alpha) through PI control based on an air-fuel ratio feedback control error (e_Rabf), which is a difference between the target exhaust manifold air-fuel ratio (TgRabf) and exhaust manifold air-fuel ratio (Rabf). The air-fuel ratio feedback correction value (Alpha) is corrected by an equal amount for fuel injection amounts of all the cylinders.

<Detection Permission and Control Stage Calculation Section (FIG. 19)>

Figure 19:
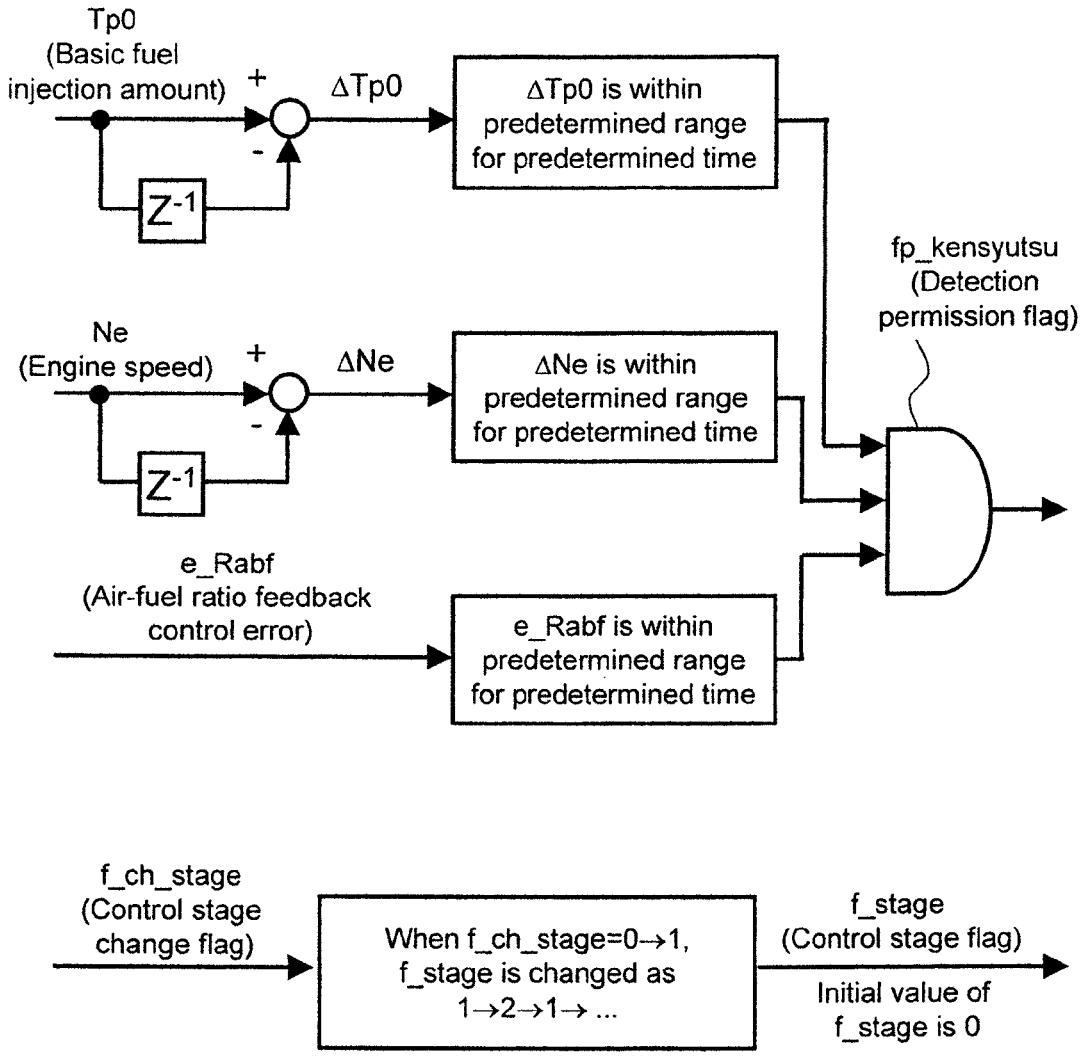
FIG. 19 is a diagram illustrating the detection permission and control stage calculation section according to Embodiments 1 to 8.

FIG. 19 is a block diagram illustrating functions of the detection permission and control stage calculation section (Embodiments 1 to 8).

The detection permission and control stage calculation section 163 shown in FIG. 16 calculates a detection permission flag (fp_kensyutsu) and a control stage (f_stage). To be more specific, as shown in FIG. 19, the detection permission and control stage calculation section 163 calculates a difference (ΔTp0) between the latest basic fuel injection amount (Tp0) and the last calculated value and calculates a difference (ΔNe) between the latest engine speed (Ne) and the last calculated value.

When "ΔTp0 is within a predetermined range for a predetermined time," "ΔNe is within a predetermined range for a predetermined time," and "air-fuel ratio feedback control error e_Rabf is within a predetermined range for a predetermined time," detection of the cylinder-specific angular acceleration characteristic, which will be described later, is permitted (fp_kensyutsu=1).

Furthermore, when the control stage change flag (f_ch_stage) 0→1, the value of the control stage flag (f_stage) is sequentially changed as 1→2→1→2→ . . . . Suppose the initial value of the control stage flag (f_stage) is 0 and the first change is 0→1.

<Cylinder-Specific Angular Acceleration Characteristic Calculation Section (FIG. 20)>

Figure 20:
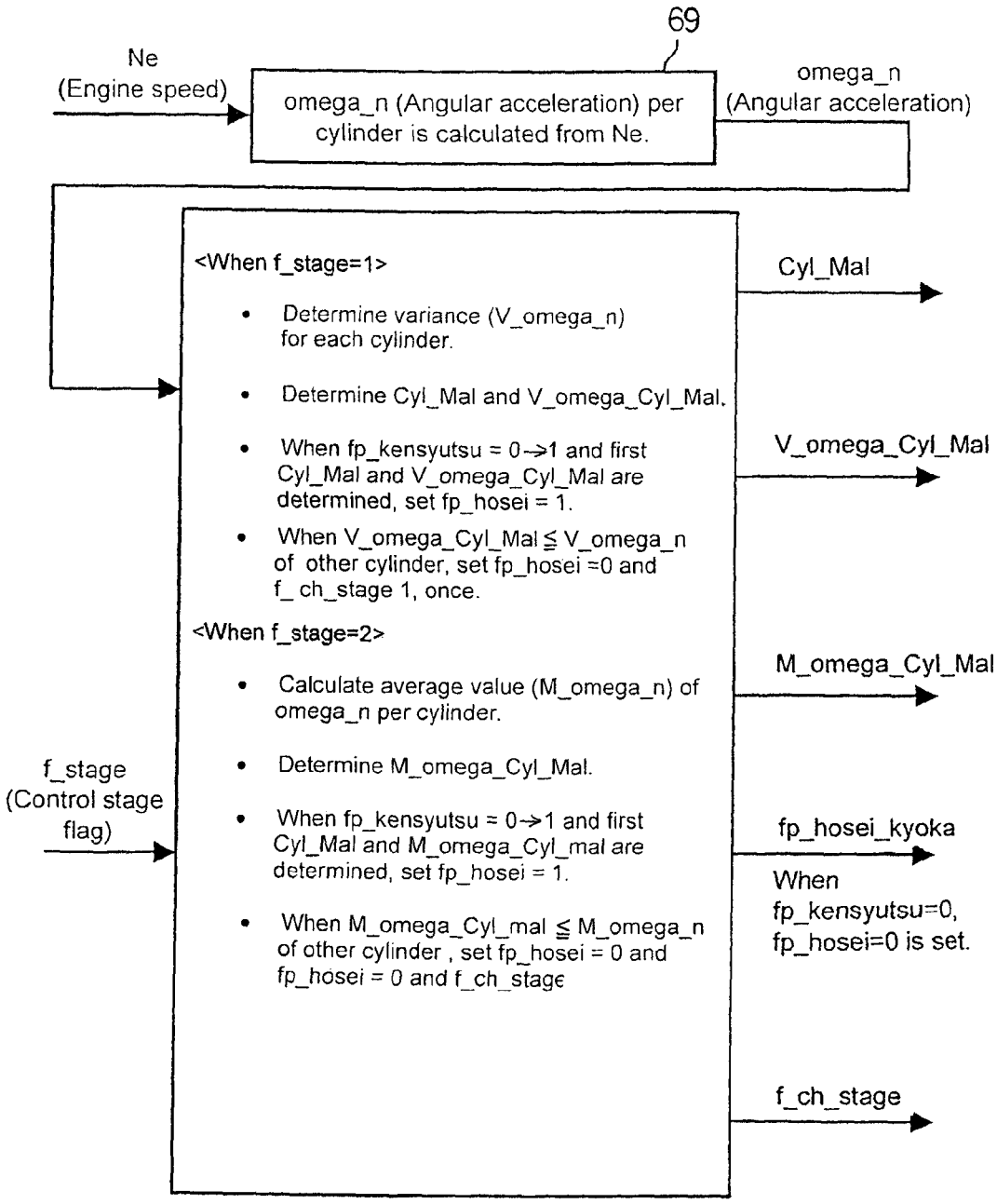
FIG. 20 is a diagram illustrating the cylinder-specific angular acceleration characteristic calculation section according to Embodiments 1, 2, 5 and 6.

FIG. 20 is a block diagram illustrating functions of the cylinder-specific angular acceleration characteristic calculation section (Embodiments 1, 2, 5, 6).

The cylinder-specific angular acceleration characteristic calculation section 164 shown in FIG. 16 calculates, according to the respective stages, cylinder number (Cyl_Mal) of the abnormal cylinder, variance (V_omega_Cyl_Mal) of angular acceleration of the abnormal cylinder, and average value (M_omega_Cyl_Mal) of angular acceleration of the abnormal cylinder, which are cylinder-specific angular acceleration characteristics. To be more specific, as shown in FIG. 20, when fp-kensyutsu (detection permission flag)=1, the following processing is performed.

Angular acceleration (omega_n) is calculated (block 69) from the engine speed (Ne) for each cylinder. (Here, "n" denotes a cylinder number.) An average value of the engine speed Ne is calculated for each combustion cycle and the difference from the last average value of the engine speed Ne is assumed to be angular acceleration (omega_n).

When stage 1 (when f_stage=1)

(1) A variance (V_omega_n) of omega_n per cylinder in a predetermined cycle is calculated from omega_n.

(2) The cylinder number of the cylinder having the largest V_omega_n is assumed as Cyl_Mal (abnormal cylinder number) and V_omega_n whose cylinder number is Cyl_Mal is assumed as V_omega_Cyl_Mal (variance of angular acceleration of the abnormal cylinder).

(3) When fp_kensyutsu=0→1 and the first Cyl_Mal and V_omega_Cyl_Mal are calculated, fp_hosei=1 is assumed.

(4) When V_omega_Cyl_Mal falls to or below V_omega_n of the other cylinders, fp_hosei=0 and f_ch_stage are set to 1 only once.

When stage 2 (when f_stage=2)

(1) An average value (M_omega_n) of omega_n per cylinder in a predetermined cycle is calculated from omega_n.

(2) When the cylinder number of the cylinder having the largest M_omega_n is Cyl_Mal (abnormal cylinder number), M_omega_n whose cylinder number is Cyl_Mal is assumed as M_omega_Cyl_Mal (average value of angular acceleration of the abnormal cylinder).

(3) When fp_kensyutsu=0→1, and the first Cyl_Mal and M_omega_Cyl_Mal are calculated, fp_hosei (correction permission flag)=1 is assumed.

(4) When M_omega_Cyl_Mal falls to or below M_omega_n of the other cylinder, fp_hosei=0 and f_ch_stage are set to 1 only once.

(5) When fp_kensyutsu=0, fp_hosei=0 is assumed.

<Cylinder-Specific Fuel Injection Amount Correction Value Calculation Section (FIG. 21)>

Figure 21:
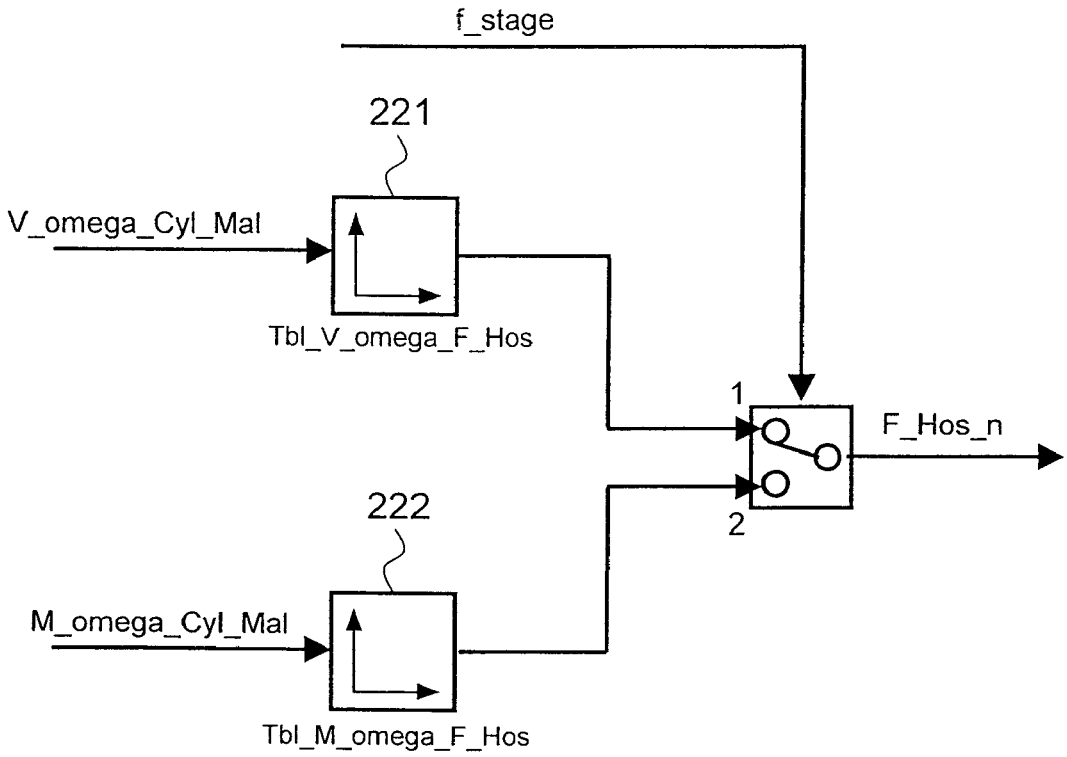
FIG. 21 is a diagram illustrating the cylinder-specific fuel injection amount correction value calculation section according to Embodiment 1.

FIG. 21 is a block diagram illustrating functions of the cylinder-specific fuel injection amount correction value calculation section (Embodiment 1).

The cylinder-specific fuel injection amount correction value calculation section 165 shown in FIG. 16 calculates a cylinder-specific fuel injection amount correction value (F_Hos_n (n is a cylinder number)) based on the angular acceleration characteristic obtained by the aforementioned cylinder-specific angular acceleration characteristic calculation section 164. To be more specific, as shown in FIG. 21, when fp_hosei=1, the following processing is performed.

Only the fuel injection amount correction value whose cylinder number is Cyl_Mal (abnormal cylinder number) is assumed to be the value calculated by this calculation section. F_Hos_n (cylinder-specific fuel injection amount correction value) of other cylinders is assumed to be 1.0.

When stage 1 (f_stage=1)

(1) With reference to a table (Tbl_V_omega_F_Hos) 221 from V_omega_Cyl_Mal, assume F_Hos_n (cylinder-specific fuel injection amount correction value) of the cylinder to be corrected (cylinder number is Cyl_Mal).

When stage 2 (when f_stage=2)

(1) With reference to a table (Tbl_M_omega_F_Hos) 222 from M_omega_Cyl_Mal, assume F_Hos_n (cylinder-specific fuel injection amount correction value) of the cylinder to be corrected (cylinder number is Cyl_mal).

The set value of Tbl_V_omega_F_Hos indicates a relationship between a variance of angular acceleration and the air-fuel ratio, and may be preferably determined from a result of a test using an actual machine. The set value of Tbl_M_omega_F_Hos indicates a relationship between an average value of angular acceleration and torque (fuel injection amount corresponding to filling efficiency) and may be preferably determined from a result of a test using an actual machine. That is, when the angular acceleration average value of the cylinder having cylinder number Cyl_Mal is greater than the angular acceleration average value of the other cylinders, correction by the cylinder-specific fuel injection amount correction value calculation section 165 is performed.

Since the magnitude of angular acceleration has a correlation with the magnitude of torque of the cylinder (abnormal cylinder), the amount of fuel of the cylinder (abnormal cylinder) is decreased so that the torque of the cylinder (abnormal cylinder) of cylinder number Cyl_Mal becomes equal to that of the other cylinders. When only the amount of fuel is reduced, the cylinder (abnormal cylinder) becomes lean, and therefore the cylinder-specific air amount correction value calculation section 166, which will be described later, reduces the amount of air (filling efficiency) of the cylinder (abnormal cylinder) together.

<Cylinder-Specific Air Amount Correction Value Calculation Section (FIG. 22)>

Figure 22:
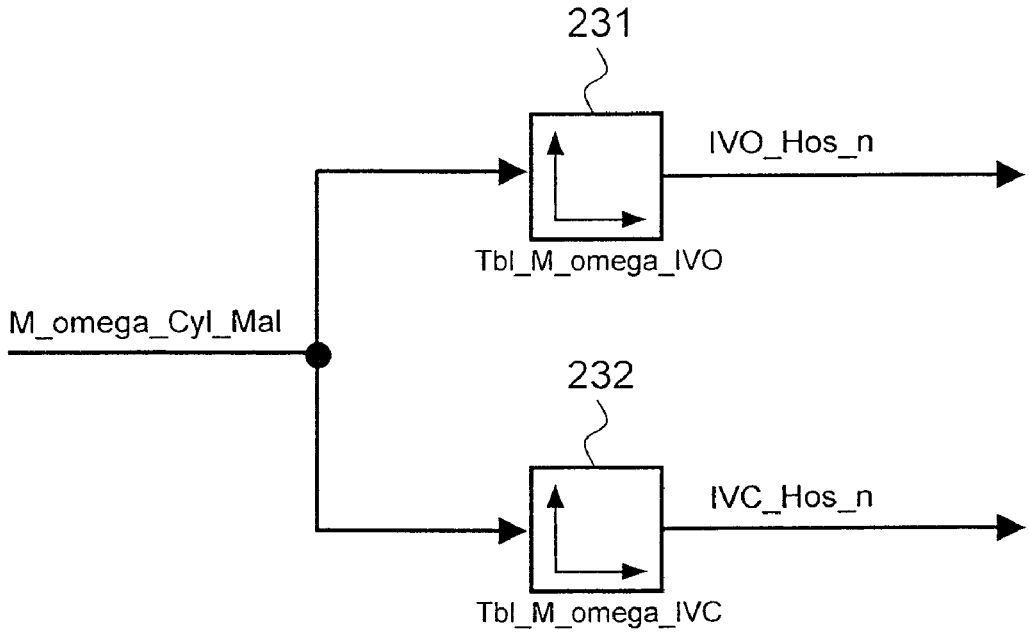
FIG. 22 is a diagram illustrating the cylinder-specific air amount correction value calculation section according to Embodiments 1 and 5.

FIG. 22 is a block diagram illustrating functions of the cylinder-specific air amount correction value calculation section (Embodiments 1, 5).

The cylinder-specific air amount correction value calculation section 166 shown in FIG. 16 calculates a cylinder-specific air amount correction value (IVO_Hos_n, IVC_Hos (n is a cylinder number)) based on the angular acceleration characteristic obtained by the aforementioned cylinder-specific angular acceleration characteristic calculation section 164. To be more specific, as shown in FIG. 22, when f_stage=2 and fp_hosei=1, the following processing is performed.

(1) Only the air amount correction value whose cylinder number is Cyl_Mal (abnormal cylinder number) is assumed to be a value calculated by this calculation section. IVO_Hos_n and IVC_Hos_n of other cylinders are assumed to be 0.

(2) With reference to a table (Tbl_M _omega_IVO) 231 from M_omega_Cyl_Mal, assume IVO_Hos_n of the cylinder to be corrected (cylinder number is Cyl_Mal).

(3) With reference to a table (Tbl_M_omega_IVC) 232 from M_omega_Cyl_Mal, assume IVC_Hos_n of the cylinder to be corrected (cylinder number is Cyl_Mal).

Since the set values of Tbl_M_omega_IVO_Hos and Tbl_M_omega_IVC_Hos indicate a relationship between the average value of angular acceleration and torque (filling efficiency), these set values may be preferably determined from a result of a test using an actual machine. That is, when the angular acceleration average value of the cylinder of cylinder number Cyl_Mal is greater than the angular acceleration average values of other cylinders, correction by the cylinder-specific air amount correction value calculation section 166 is performed.

Since the magnitude of angular acceleration has a correlation with the magnitude of torque of the cylinder (abnormal cylinder), the amount of air (filling efficiency) of the cylinder (abnormal cylinder) is decreased so that the torque of the cylinder (abnormal cylinder) of cylinder number Cyl_Mal becomes equal to that of the other cylinders (cylinders other than abnormal cylinder). When only the amount of air is reduced, the cylinder (abnormal cylinder) becomes rich, and therefore the aforementioned cylinder-specific amount of fuel correction value calculation section 165 reduces the amount of fuel of the cylinder (abnormal cylinder) together.

The control apparatus 1A according to Embodiment 1 judges that the difference between the target air-fuel ratio and the real air-fuel ratio is equal to or below a predetermined value when air-fuel ratio feedback control based on the air-fuel ratio of the exhaust manifold is in progress. When it is judged that the difference between the target air-fuel ratio and the real air-fuel ratio is equal to or below the predetermined value, it is judged that the real air-fuel ratio has converged to the vicinity of the target air-fuel ratio and a variation of angular acceleration having a correlation with an in-pipe pressure (variance, average value) is detected for each cylinder.

Of the plurality of cylinders, a cylinder having the largest variation of angular acceleration is identified as an abnormal cylinder (lean cylinder), the fuel injection amount of the abnormal cylinder is corrected so as to increase and the air-fuel ratio of the abnormal cylinder is corrected to the rich side.

In this case, the air-fuel ratio of the exhaust manifold (average air-fuel ratio of all the cylinders) temporarily shifts to the rich side due to the influence that the air-fuel ratio of the abnormal cylinder is corrected to the rich side, but the air-fuel ratio feedback control functions so that all the cylinders are uniformly corrected to the lean side, and as a result, air-fuel ratios of all the cylinders are controlled to the vicinity of the target air-fuel ratio.

Of the plurality of cylinders, when attention is focused on a specific cylinder, the air-fuel ratio is not always shifted to the lean side, but even if the air-fuel ratio is shifted to the rich side, the other cylinders are shifted to the lean side through air-fuel ratio feedback control, and therefore abnormal cylinders are generated anyway. Furthermore, frequently performing this control allows only a cylinder that has become leanest to be successively corrected as an abnormal cylinder, and as a result, it is possible to suppress variations of air-fuel ratios of all the cylinders all the time.

After the air-fuel ratio of the abnormal cylinder is corrected to the rich side by fuel amount increasing correction, angular acceleration of the abnormal cylinder subjected to fuel amount increasing correction or an average value thereof is compared with angular acceleration of cylinders other than the abnormal cylinder or an average value thereof, and when angular acceleration of the abnormal cylinder or an average value thereof is greater than angular acceleration of cylinders other than the abnormal cylinder or an average value thereof, the amount of air of the abnormal cylinder is judged to be greater than the amount of air of the cylinders other than the abnormal cylinder.

When the cause of the leanness of the abnormal cylinder is an unintended increase of the amount of air, although the air-fuel ratio of the abnormal cylinder is modified (converged to the vicinity of the target air-fuel ratio) by fuel amount increasing correction, the amount of fuel supplied is greater than that of the cylinders other than the abnormal cylinder and the torque generated is greater. That is, angular acceleration of the crank shaft generated upon combustion of the abnormal cylinder is greater than angular acceleration generated upon combustion of the cylinders other than the abnormal cylinder.

Therefore, when the average value of angular acceleration of the abnormal cylinder is greater than the average value of angular acceleration of the cylinders other than the abnormal cylinder, it is possible to judge that the amount of air of the abnormal cylinder is, greater than the amount of air of the cylinders other than the abnormal cylinder.

The amount of air and amount of fuel of the abnormal cylinder judged to have a greater amount of air are corrected so as to increase. That is, to eliminate the difference between the torque generated of the abnormal cylinder judged to have the greater amount of air and the torque generated of the cylinders other than the abnormal cylinder, correction is made so as to reduce the amount of air of the abnormal cylinder which is the cause of the difference.

In this case, the amount of fuel is also corrected so as to decrease according to the decrease in the amount of air so that the air-fuel ratio of the abnormal cylinder does not become rich. As a result, it is possible to eliminate variations in the air-fuel ratio and torque between the abnormal cylinder and the cylinders other than the abnormal cylinder.

Furthermore, the control apparatus 1A according to Embodiment 1 identifies an abnormal cylinder and calculates an average value of angular acceleration for each cylinder. The control apparatus 1A then compares the angular acceleration average value of the abnormal cylinder with the angular acceleration average value of the cylinders other than the abnormal cylinder and corrects, when the angular acceleration average value of the abnormal cylinder is smallest, the amount of fuel of the abnormal cylinder so as to increase.

When the cause of the leanness of the abnormal cylinder is an unexpected decrease of the amount of fuel, the torque of the abnormal cylinder is reduced, and therefore the angular acceleration average value of the abnormal cylinder is smaller than the angular acceleration average value of the cylinders other than the abnormal cylinder.

On the other hand, when the cause of the leanness of the abnormal cylinder is an unexpected increase of the amount of air, the amount of fuel has not decreased, and therefore the torque of the abnormal cylinder hardly becomes smaller and the angular acceleration average value of the abnormal cylinder hardly becomes smaller than the angular acceleration average value of the cylinders other than the abnormal cylinder, either.

Therefore, when the angular acceleration average value of the abnormal cylinder is compared with the average value of the cylinders other than the abnormal cylinder, if angular acceleration average value of the abnormal cylinder is smallest, it is possible to judge that an unexpected decrease of the amount of fuel has occurred and it is possible to resolve both the leaning of the air-fuel ratio of the abnormal cylinder and torque reduction by increasing the amount of fuel of the abnormal cylinder.

Figure 23:
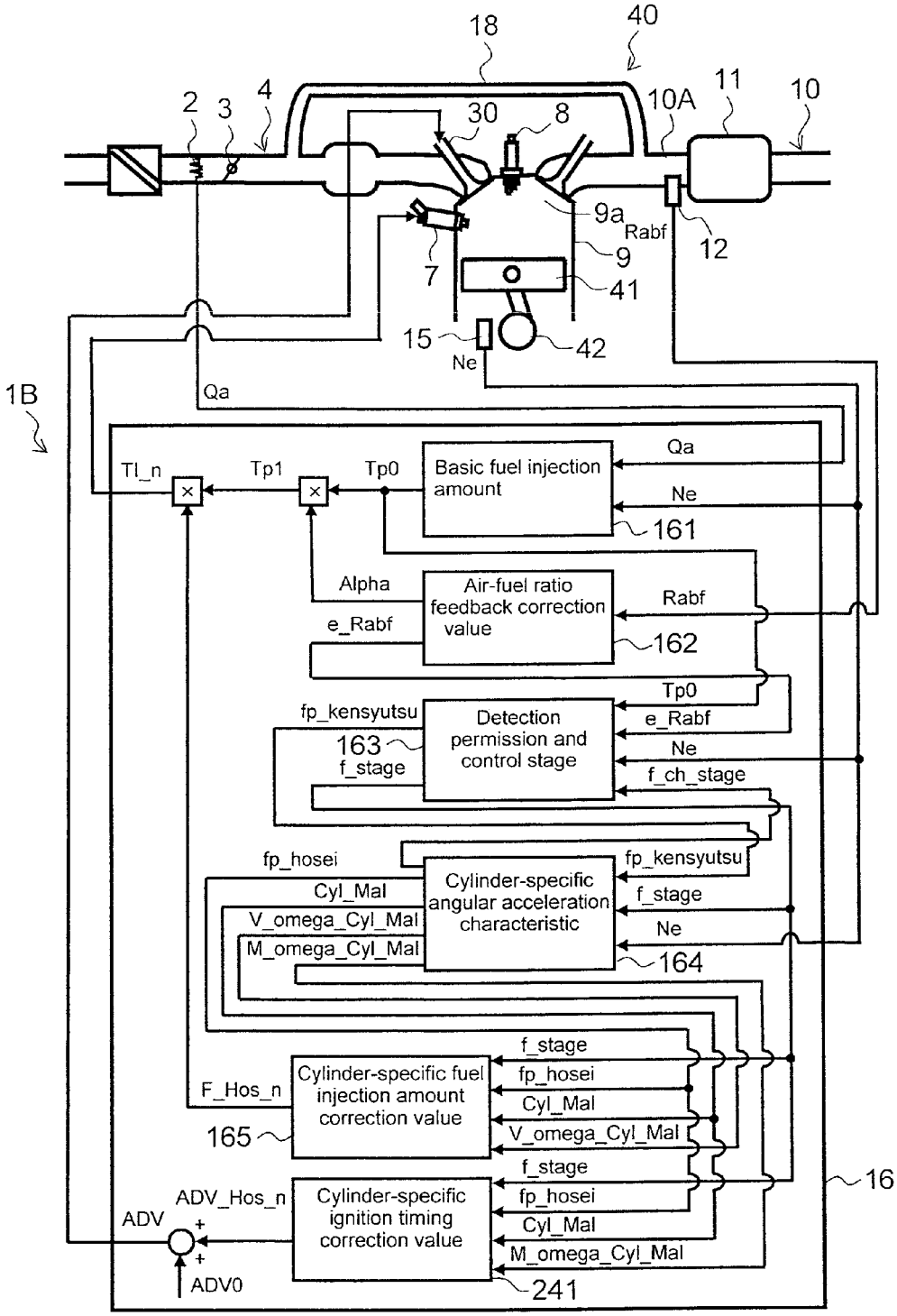
FIG. 23 is a control system diagram according to Embodiments 2 and 6.
Figure 24:
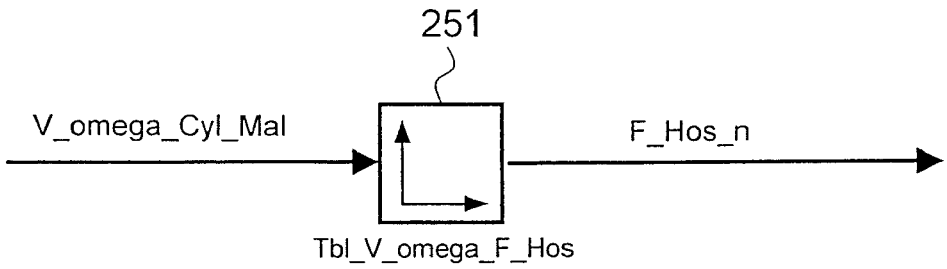
FIG. 24 is a diagram illustrating the cylinder-specific fuel injection amount correction value calculation section according to Embodiment 2.
Figure 25:
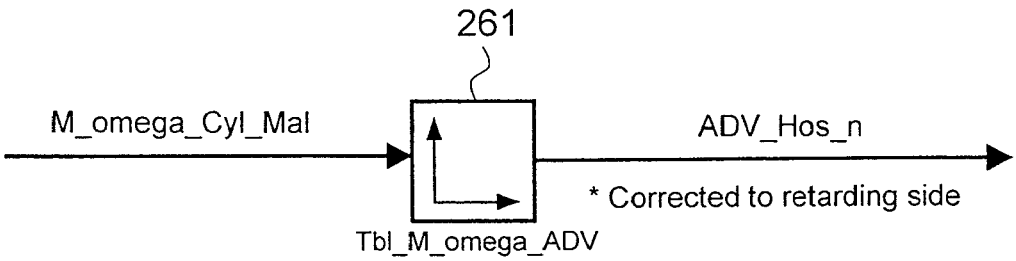
FIG. 25 is a diagram illustrating the cylinder-specific ignition timing correction value calculation section according to Embodiments 2 and 6.

[Embodiment 2: FIG. 23 to FIG. 25]

A case has been described in aforementioned Embodiment 1 where the amount of fuel of the abnormal cylinder is corrected so as to increase, the air-fuel ratio of the abnormal cylinder is corrected to the rich side, and when the torque of the abnormal cylinder after the correction is greater than the torque of the cylinders other than the abnormal cylinder, the amount of fuel and the amount of air of the abnormal cylinder are corrected so as to decrease, whereas in Embodiment 2, instead of correcting the amount of fuel and the amount of air of the abnormal cylinder so as to decrease, ignition timing of the abnormal cylinder is corrected so as to retard. That is, in Embodiment 2, the amount of fuel of the abnormal cylinder is corrected so as to increase, the air-fuel ratio of the abnormal cylinder is corrected to the rich side, and when the torque of the abnormal cylinder after the correction is greater than the torque of the cylinders other than the abnormal cylinder, ignition timing of the abnormal cylinder is corrected so as to retard.

FIG. 23 is a control system diagram illustrating a control apparatus 1B according to (Embodiments 2, 6).

The engine control unit 16 of the control apparatus 1B in the figure is different from Embodiment 1 in the specification of the cylinder-specific fuel injection amount correction value calculation section 165. Furthermore, Embodiment 2 is different from Embodiment 1 in that there is no section corresponding to the cylinder-specific air amount correction value calculation section 166 in Embodiment 1 and a cylinder-specific ignition timing correction value calculation section 241 is newly provided. Since the other means are substantially the same as those in Embodiment 1, parts different from those in Embodiment 1 will be described with emphasis placed thereon.

The cylinder-specific ignition timing correction value calculation section 241 calculates a cylinder-specific ignition timing correction value (ADV_Hos_n) based on an angular acceleration characteristic calculated by the aforementioned cylinder-specific angular acceleration characteristic calculation section 164. Here, ADV_Hos_n is a correction value applied to basic ignition timing (ADV0). There are conventionally various methods for calculating the basic ignition timing (ADV0) (value set so that fuel consumption becomes optimum in each operation condition), but these methods are not directly related to the present invention, and so detailed descriptions thereof will be omitted here.

In Embodiment 2, the following processes will be controlled.

When stage 1 (when f_stage=1)

(1) A variance of angular acceleration is calculated for each cylinder and a cylinder having the largest variance of angular acceleration (leanest cylinder: lean cylinder) is detected as an abnormal cylinder (Cyl_Mal). The variance of angular acceleration of the cylinder of cylinder number Cyl_Mal, that is, the abnormal cylinder is assumed to be V_omega_Cyl_Mal.

(2) The fuel injection amount of the abnormal cylinder is corrected so as to increase (F_Hos_n) based on V_omega_Cyl_Mal.

When stage 2 (when f_stage=2)

(1) Performed after stage 1 ends.

(2) An average value of angular acceleration is calculated for each cylinder, and when the cylinder number of the largest average value of angular acceleration matches the cylinder number (Cyl_Mal) of the abnormal cylinder, the average value of angular acceleration of the cylinder is assumed to be M_omega_Cyl_Mal (average value of angular acceleration of the abnormal cylinder).

(3) Ignition timing of the cylinder (abnormal cylinder) is corrected to the retarding side (ADV_Hos_n) based on M_omega_Cyl_Mal.

Hereinafter, the cylinder-specific fuel injection amount correction value calculation section 165 and the cylinder-specific ignition timing correction value calculation section 241 will be described in detail.

<Cylinder-Specific Fuel Injection Amount Correction Value Calculation Section (FIG. 24)>

FIG. 24 is a block diagram illustrating functions of the cylinder-specific fuel injection amount correction value calculation section (Embodiment 2).

The cylinder-specific fuel injection amount correction value calculation section 165 shown in FIG. 23 calculates a cylinder-specific fuel injection amount correction value (F_Hos_n (n is a cylinder number)) based on the angular acceleration characteristic obtained by the aforementioned cylinder-specific angular acceleration characteristic calculation section 164. To be more specific, as shown in FIG. 24, when f_stage=1 and fp_hosei (Correction Permission flag)=1, the following processing will be performed.

Only the fuel injection amount correction value whose cylinder number is Cyl_Mal (abnormal cylinder number) is assumed to be a value calculated by this calculation section. F_Hos-n (cylinder-specific fuel injection amount correction value) of the other cylinders is assumed to be 1.0.

With reference to a table (Tbl_V_omega_F_Hos) 251 from V_omega_Cyl_Mal, assume F_Hos_n (cylinder-specific fuel injection amount correction value) of the cylinder to be corrected (cylinder number is (Cyl_Mal).

The set value of Tbl_V_omega_F_Hos indicates a relationship between a variance of angular acceleration and an air-fuel ratio and may be preferably determined from a result of a test using an actual machine.

<Cylinder-Specific Ignition Timing Correction Value Calculation Section (FIG. 25)>

FIG. 25 is a block diagram illustrating functions of the cylinder-specific ignition timing correction value calculation section (Embodiments 2, 6).

The cylinder-specific ignition timing correction value calculation section 241 shown in FIG. 23 calculates a cylinder-specific ignition timing correction value (ADV_Hos_n (n is a cylinder number)) based on the angular acceleration characteristic obtained by the aforementioned cylinder-specific angular acceleration characteristic calculation section 164. To be more specific, as shown in FIG. 25, when f_stage=2 and fp_hosei=1, the following processing will be performed.

(1) Only the ignition timing correction value whose cylinder number is Cyl_Mal (abnormal cylinder number) is assumed to be a value calculated by this calculation section. ADV_Hos_n (cylinder-specific ignition timing correction value) of the other cylinders is assumed to be 0.

(2) With reference to a table (Tbl_M_omega_ADV) 261 from M_omega_Cyl_Mal, assume ADV_Hos_n (cylinder-specific ignition timing correction value) of the cylinder to be corrected (cylinder number is Cyl_Mal).

The set value of Tbl_M_omega_ADV indicates a relationship between an average value of angular acceleration and an amount of ignition timing retarding and may be preferably determined from a result of a test using an actual machine.

The control apparatus 1B according to Embodiment 2 corrects the fuel injection amount of the abnormal cylinder so as to increase and corrects the air-fuel ratio of the abnormal cylinder to the rich side. After correcting the air-fuel ratio of the abnormal cylinder to the rich side by fuel amount increasing correction, the control apparatus 1B compares the angular acceleration of abnormal cylinder subjected to the fuel amount increasing correction or an average value thereof with angular acceleration of the cylinders other than the abnormal cylinder or an average value thereof, and judges, when angular acceleration of the abnormal cylinder or an average value thereof is greater than angular acceleration of the cylinders other than the abnormal cylinder or an average value thereof, that the amount of air of the abnormal cylinder is greater than the amount of air of the cylinders other than the abnormal cylinder. That is, after correcting the amount of fuel of the abnormal cylinder so as to increase, the control apparatus 1B compares the angular acceleration of the abnormal cylinder or an average value thereof with the angular acceleration of the cylinders other than the abnormal cylinder or an average value thereof again.

In this case, when the cause of the leanness of the abnormal cylinder is an unintended increase of the amount of air, although the air-fuel ratio of the abnormal cylinder is modified (converged to the vicinity of the target air-fuel ratio) by fuel amount increasing correction, the amount of fuel supplied is greater than that of the cylinders other than the abnormal cylinder, and so the torque generated is greater. That is, angular acceleration generated upon combustion of the abnormal cylinder is greater than angular acceleration generated upon combustion of the cylinders other than the abnormal cylinder.

Therefore, when angular acceleration of the abnormal cylinder or an average value thereof is greater than angular acceleration of the cylinders other than the abnormal cylinder or an average value thereof, it is possible to judge that the amount of air of the abnormal cylinder is greater than the amount of air of the cylinders other than the abnormal cylinder.

Ignition timing of the abnormal cylinder judged to have a greater amount of air is corrected to the retarding side. That is, to eliminate the difference between the torque generated of the abnormal cylinder judged to have the greater amount of air and the torque generated of the cylinders other than the abnormal cylinder, ignition timing of the abnormal cylinder is corrected to the retarding side. As a result, it is possible to eliminate variations in the air-fuel ratio and torque between the abnormal cylinder and the cylinders other than the abnormal cylinder.

[Embodiment 3: FIG. 26 to FIG. 29]

Embodiment 3 corrects an amount of air of the abnormal cylinder so as to decrease and corrects the air-fuel ratio of the abnormal cylinder to the rich side, and corrects, when torque of the abnormal cylinder after the correction is smaller than torque of the cylinders other than the abnormal cylinder, the amount of fuel and the amount of air of the abnormal cylinder so as to increase.

Figure 26:
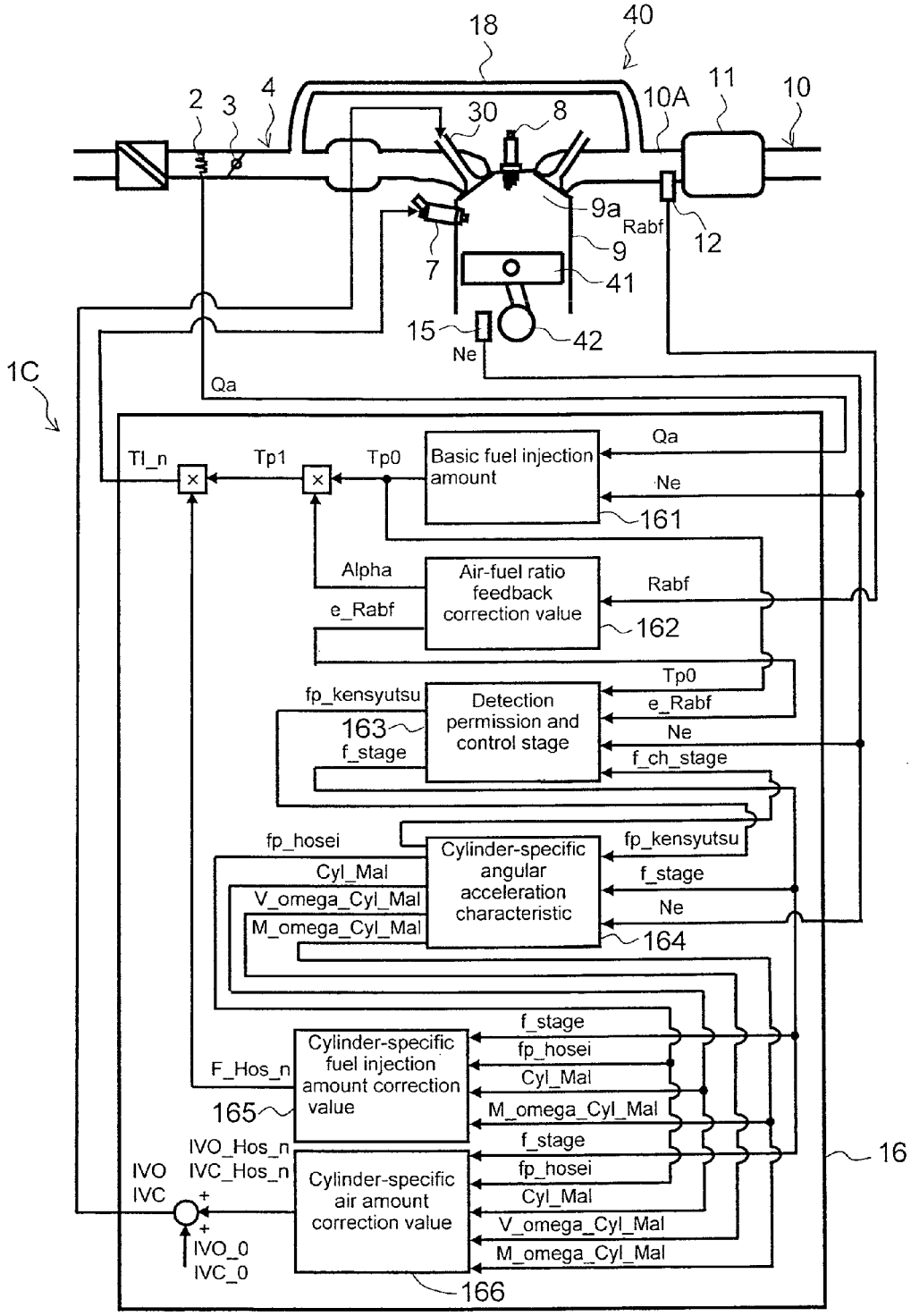
FIG. 26 is a control system diagram according to Embodiments 3 and 7.

FIG. 26 is a control system diagram illustrating a control apparatus 1C according to (Embodiments 3, 7).

Present Embodiment 3 is only different from above described Embodiment 1 in the specifications of the cylinder-specific angular acceleration characteristic calculation section 164, cylinder-specific fuel injection amount correction value calculation section 165 and cylinder-specific air amount correction value calculation section 166, and other means are substantially the same, and therefore only calculation sections having different specifications will be described with emphasis placed thereon below.

In Embodiment 3, the following processes will be controlled.

Stage 1 (when f_stage=1)

(1) A variance of angular acceleration is calculated for each cylinder and a cylinder having the largest variance of angular acceleration (leanest cylinder: lean cylinder) is detected as an abnormal cylinder (Cyl_Mal). The variance of angular acceleration of the cylinder of cylinder number Cyl_Mal (abnormal cylinder) is assumed to be V_omega_Cyl_Mal.

(2) The amount of air of the leanest cylinder (abnormal cylinder) is corrected so as to decrease based on V_omega_Cyl_Mal (IVO_Hos_n, IVC_Hos_n).

Stage 2 (when f_stage=2)

(1) Performed after stage 1 ends.

(2) An average value of angular acceleration is calculated for each cylinder, and when the cylinder number of the cylinder having the smallest average value of angular acceleration matches Cyl_Mal (cylinder number of the abnormal cylinder), the average value of angular acceleration of the cylinder (abnormal cylinder) is assumed to be M_omega_Cyl_Mal (average value of angular acceleration of the abnormal cylinder).

(3) The amount of fuel injection and amount of air of the cylinder (abnormal cylinder) are corrected so as to increase (F_Hos_n, IVO_Hos_n, IVC_Hos_n) based on M_omega_Cyl_Mal.

Hereinafter, the cylinder-specific angular acceleration characteristic calculation section 164, cylinder-specific fuel injection amount correction value calculation section 165 and cylinder-specific air amount correction value calculation section 166 according to present Embodiment 3 will be described in detail.

<Cylinder-Specific Angular Acceleration Characteristic Calculation Section (FIG. 27)>

Figure 27:
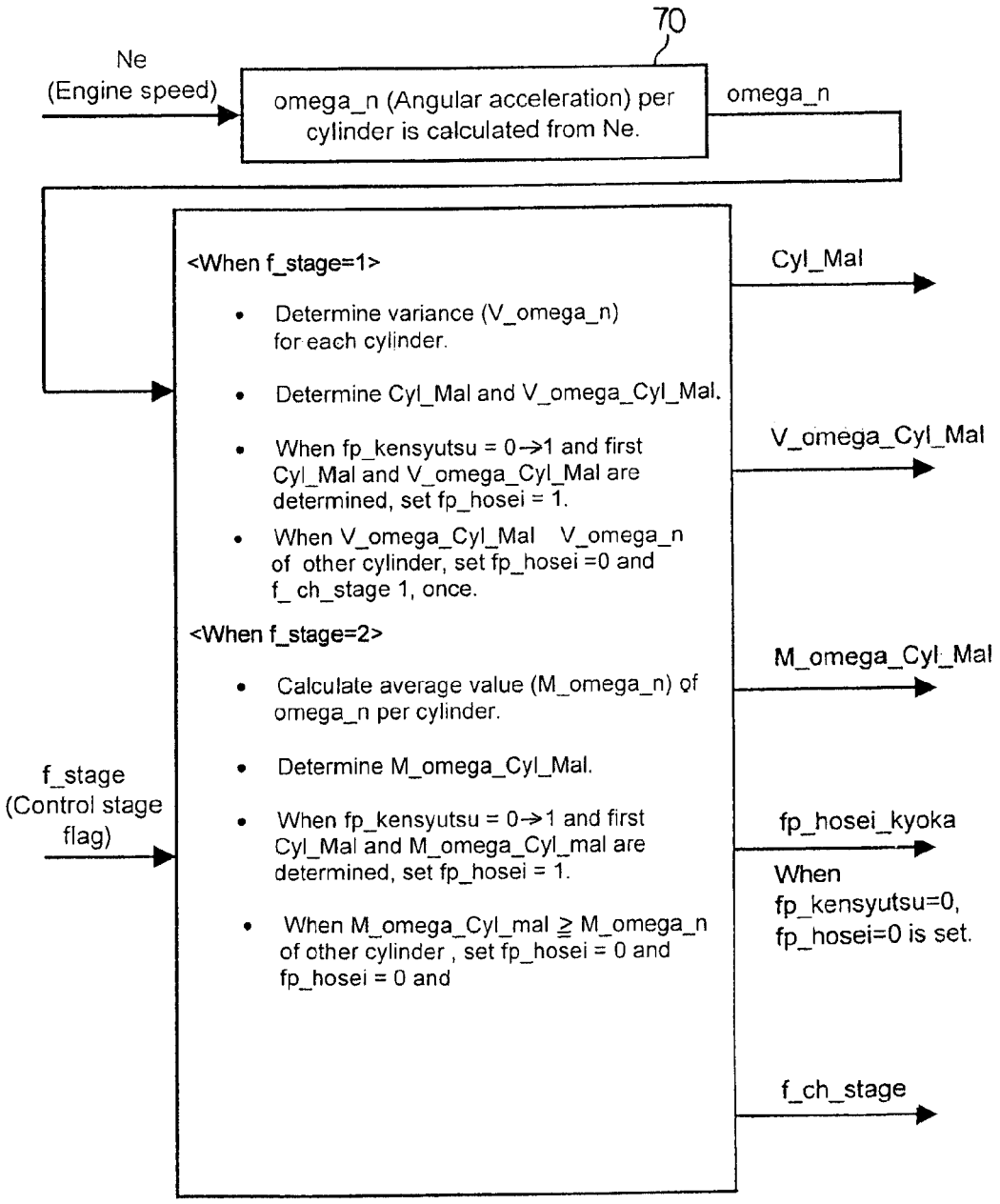
FIG. 27 is a diagram illustrating the cylinder-specific angular acceleration characteristic calculation section according to Embodiments 3, 4, 7 and 8.

FIG. 27 is a block diagram illustrating functions of the cylinder-specific angular acceleration characteristic calculation section (Embodiments 3, 4, 7, 8).

The cylinder-specific angular acceleration characteristic calculation section 164 shown in FIG. 26 calculates, according to the respective stages, a cylinder number (Cyl_Mal) of the abnormal cylinder, variance of angular acceleration of the abnormal cylinder (V_omega_Cyl_Mal), average value of angular acceleration of the abnormal cylinder (M_omega_Cyl_Mal), which are cylinder-specific angular acceleration characteristics.

To be more specific, as shown in FIG. 27, the following processing is performed when fp_kensyutsu (detection permission flag)=1.

Angular acceleration (omega_n) is calculated (block 70) for each cylinder from the engine speed (Ne). Here, n denotes a cylinder number. An average value of Ne is calculated every combustion cycle and angular acceleration (omega_n) is assumed to be a difference from the last Ne. (n is cylinder number.)

When stage 1 (when f_stage=1)

(1) A variance of omega_n per cylinder (V_omega_n) in a predetermined cycle is calculated from omega_n.

(2) A cylinder number having the largest V-omega_n is assumed to be Cyl_Mal (abnormal cylinder number) and V_omega_n whose cylinder number is Cyl_Mal is assumed to be V_omega_Cyl_Mal (variance of angular acceleration of the abnormal cylinder).

(3) When fp_kensyutsu=0→1 and first Cyl_Mal and V_omega_Cyl_Mal is determined, fp_hosei (correction permission flag)=1 is set.

(4) When V_omega_Cyl_Mal falls to or below V_omega_n of the other cylinder, fp_hosei=0 and f_ch_stage are set to 1 only once.

When stage 2 (when f_stage=2)

(1) An average value of omega_n (M_omega_n) per cylinder in a predetermined cycle is calculated from omega_n.

(2) When a cylinder number of the cylinder having the smallest M_omega_n is Cyl_Mal (cylinder number of the abnormal cylinder), M_omega_n whose cylinder number is Cyl_Mal is assumed to be M_omega_Cyl_Mal (average value of angular acceleration of the abnormal cylinder).

(3) When fp_kensyutsu=0→1 and first Cyl_Mal and M_omega_Cyl_Mal is determined, fp_hosei (correction permission flag)=1 is set.

(4) When M_omega_Cyl_Mal exceeds M_omega_n of the other cylinder, fp_hosei=0 and f_ch_stage are set to 1 only once.

(5) When fp_kensyutsu=0, fp_hosei=0 is set.

<Cylinder-Specific Fuel Injection Amount Correction Value Calculation Section (FIG. 28)>

Figure 28:
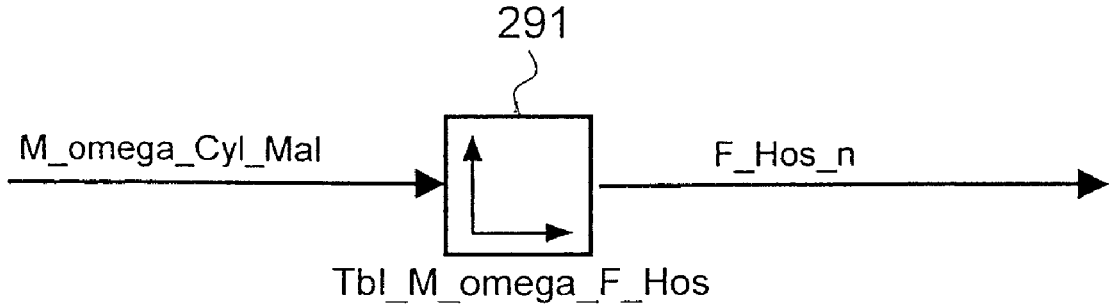
FIG. 28 is a diagram illustrating the cylinder-specific fuel injection amount correction value calculation section according to Embodiments 3 and 7.

FIG. 28 is a block diagram illustrating functions of the cylinder-specific fuel injection amount correction value calculation section (Embodiments 3, 7).

The cylinder-specific fuel injection amount correction value calculation section 165 shown in FIG. 26 calculates a cylinder-specific fuel injection amount correction value (F_Hos_n (n is a cylinder number)) based on the angular acceleration characteristic obtained by the aforementioned cylinder-specific angular acceleration characteristic calculation section 164. To be more specific, as shown in FIG. 28, when f_stage=2 and fp_hosei (Correction Permission flag)=1, the following processing is performed.

Only the fuel injection amount correction value whose cylinder number is Cyl_Mal is assumed to be a value calculated by this calculation section. F_hos_n (cylinder-specific fuel injection amount correction value) of other cylinders is assumed to be 1.0.

With reference to a table (Tbl_M_omega_F_Hos) 291 from M_omega_Cyl_Mal, assume F_Hos_n (cylinder-specific fuel injection amount correction value) of the cylinder to be corrected (cylinder number is Cyl_Mal).

The set value of Tbl_M_omega_F_Hos indicates a relationship between an average value of angular acceleration and torque (fuel injection amount corresponding to filling efficiency), and may be preferably determined from a result of a test using an actual machine. That is, when the angular acceleration average value of the cylinder of cylinder number Cyl_Mal (abnormal cylinder) is smaller than the angular acceleration average value of the other cylinders (cylinders other than the abnormal cylinder), correction by this calculation section is performed.

Since the magnitude of angular acceleration has a correlation with the magnitude of torque of the cylinder (abnormal cylinder), the amount of fuel of the cylinder (abnormal cylinder) is increased so that torque of the cylinder of cylinder number Cyl_Mal (abnormal cylinder) becomes equal to that of the other cylinders (cylinders other than the abnormal cylinder). When only the amount of fuel is increased, the cylinder (abnormal cylinder) becomes rich, and therefore the cylinder-specific air amount correction value calculation section 166, which will be described later, also increases the amount of air (filling efficiency) of the cylinder (abnormal cylinder) together.

<Cylinder-Specific Air Amount Correction Value Calculation Section (FIG. 29)>

Figure 29:
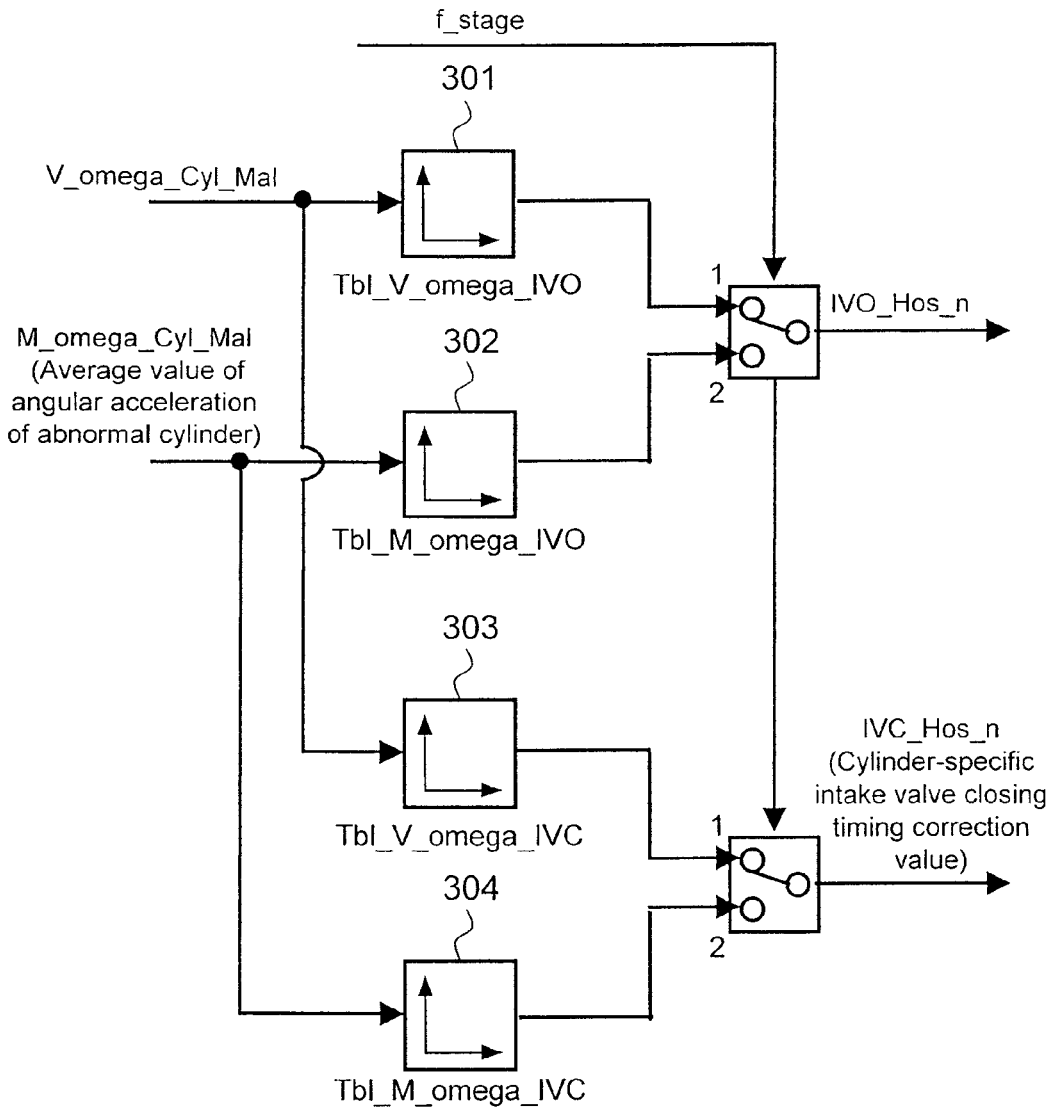
FIG. 29 is a diagram illustrating the cylinder-specific air amount correction value calculation section according to Embodiment 3.

FIG. 29 is a block diagram illustrating functions of the cylinder-specific air amount correction value calculation section 166 (Embodiment 3).

The cylinder-specific air amount correction value calculation section 166 shown in FIG. 26 calculates a cylinder-specific air amount correction value (IVO_Hos_n, IVC_Hos (n is a cylinder number)) based on the angular acceleration characteristic obtained by the aforementioned cylinder-specific angular acceleration characteristic calculation section 164. To be more specific, as shown in FIG. 29, when fp_hosei (Correction Permission flag)=1, the following processing will be performed.

Only the air amount correction value whose cylinder number is Cyl_Mal is assumed to be a value calculated by this calculation section. IVO_Hos_n and IVC_Hos_n of other cylinders are assumed to be 0.

When stage 1 (when f_stage=1)

(1) With reference to a table (Tbl_V_omega_IVO) 301 from V_omega_Cyl_Mal, assume IVO_Hos_n of the cylinder to be corrected (cylinder number is (Cyl_Mal).

(2) With reference to a table (Tbl_V_omega_WC) 303 from V_omega_Cyl_Mal, assume IVC_Hos_n of the cylinder to be corrected (whose cylinder number is Cyl_Mal).

When stage 2 (when f_stage=2)

(1) With reference to a table (Tbl_M_omega_IVO) 302 from M_omega_Cyl_Mal, assume IVO_Hos_n of the cylinder to be corrected (whose cylinder number is Cyl_Mal).

(2) With reference to a table (Tbl_M_omega_IVC) 304 from M_omega_Cyl_Mal, assume IVC_Hos_n of the cylinder to be corrected (whose cylinder number is Cyl_Mal).

The set values of Tbl_V_omega_IVO_Hos and Tbl_V_omega_IVC_Hos indicate a relationship between a variance of angular acceleration and an air-fuel ratio, and may be preferably determined from a result of a test using an actual machine. The set values of Tbl_M_omega_IVO_Hos and Tbl_M_omega_IVC_Hos indicate a relationship between an average value of angular acceleration and torque (filling efficiency), and may be preferably determined from a result of a test using an actual machine.

When the angular acceleration average value of the cylinder of cylinder number Cyl_Mal (abnormal cylinder) is smaller than the angular acceleration average value of other cylinders (cylinders other than the abnormal cylinder), correction by this calculation section is performed. Since the magnitude of angular acceleration has a correlation with the magnitude of torque of the cylinder (abnormal cylinder), the amount of air (filling efficiency) of the cylinder (abnormal cylinder) is increased so that the torque of the cylinder of cylinder number Cyl_Mal (abnormal cylinder) becomes equal to that of the other cylinders (cylinders other than the abnormal cylinder). When only the amount of air is increased, the cylinder (abnormal cylinder) becomes lean, and therefore the aforementioned cylinder-specific fuel correction amount value calculation section 165 also increases the amount of fuel of the abnormal cylinder together.

The control apparatus 1C according to Embodiment 3 corrects the amount of air of the abnormal cylinder so as to decrease and corrects the air-fuel ratio of the abnormal cylinder to the rich side. The control apparatus 1C corrects the air-fuel ratio of the abnormal cylinder to the rich side by air amount decreasing correction, then compares angular acceleration of the abnormal cylinder subjected to the air amount decreasing correction or an average value thereof with angular acceleration of the cylinders other than the abnormal cylinder or an average value thereof, and judges, when angular acceleration of the abnormal cylinder or an average value thereof is smaller than angular acceleration of the cylinders other than the abnormal cylinder or an average value thereof, that the amount of fuel of the abnormal cylinder is smaller than that of the cylinders other than the abnormal cylinder. That is, after correcting the abnormal cylinder by decreasing the amount of air, the control apparatus 1C compares the angular acceleration of the abnormal cylinder or an average value thereof with the angular acceleration of the cylinders other than the abnormal cylinder or an average value thereof again.

In this case, when the cause of the leanness of the abnormal cylinder is an unintended decrease of the amount of fuel, although the air-fuel ratio of the abnormal cylinder is modified (converged to the vicinity of the target air-fuel ratio) by air amount decreasing correction, the amount of fuel supplied is smaller than that of the cylinders other than the abnormal cylinder, and therefore the torque generated is smaller. That is, angular acceleration generated upon combustion of the abnormal cylinder is smaller than angular acceleration generated upon combustion of the cylinders other than the abnormal cylinder.

Therefore, when angular acceleration of the abnormal cylinder or an average value thereof is smaller than angular acceleration of the cylinders other than the abnormal cylinder or an average value thereof, it is possible to judge that the amount of fuel of the abnormal cylinder is smaller than the amount of fuel of the cylinders other than the abnormal cylinder.

Correction is made so that the amount of air and amount of fuel of the abnormal cylinder judged to have the smaller amount of fuel are increased. That is, to eliminate the difference between the torque generated of the abnormal cylinder judged to have the smaller amount of fuel and the torque generated of the cylinders other than the abnormal cylinder, correction is made so as to increase the amount of fuel of the abnormal cylinder which is the cause of the difference.

In this case, correction is made so as to also increase the amount of air according to the increase in the amount of fuel so that the air-fuel ratio of the abnormal cylinder does not become rich. As a result, it is possible to reduce variations in the air-fuel ratio and torque between the abnormal cylinder and the cylinders other than the abnormal cylinder.

Figure 30:
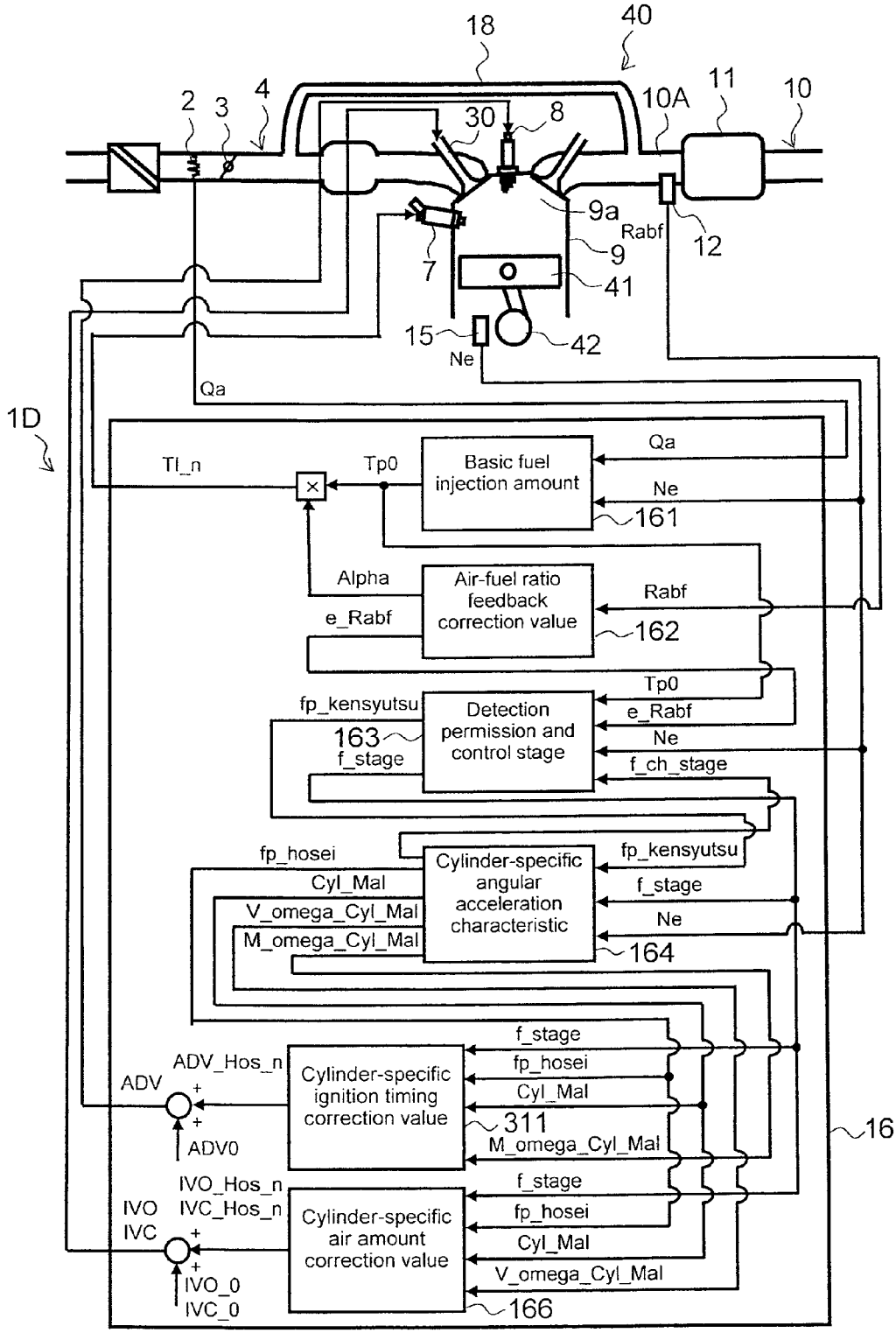
FIG. 30 is a control system diagram according to Embodiments 4 and 8.
Figure 31:
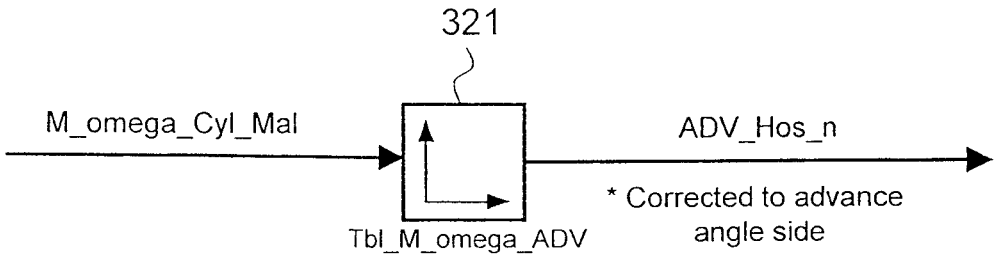
FIG. 31 is a diagram illustrating the cylinder-specific ignition timing correction value calculation section according to Embodiments 4 and 8.
Figure 32:
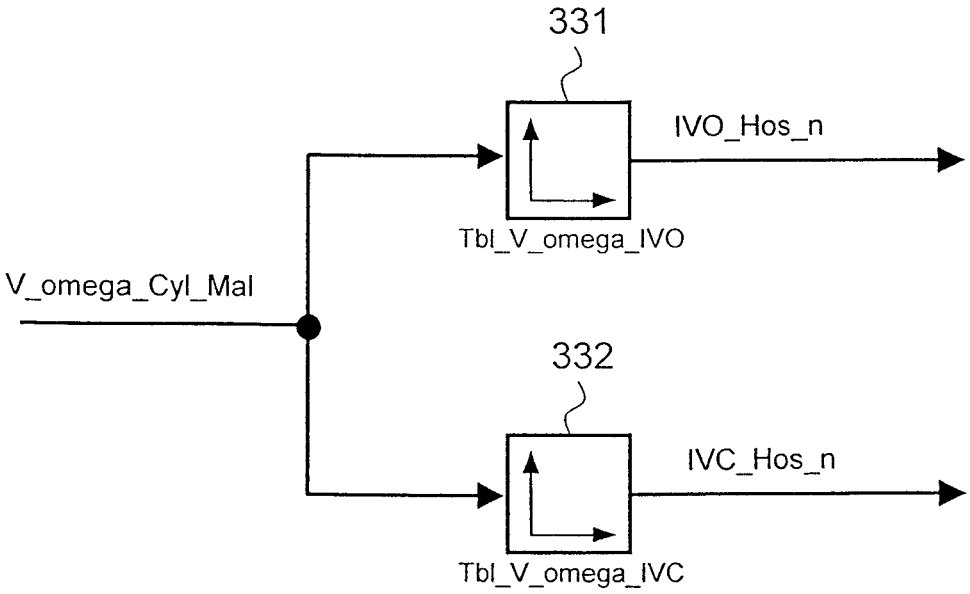
FIG. 32 is a diagram illustrating the cylinder-specific air amount correction value calculation section according to Embodiment 4.

[Embodiment 4: FIG. 30 to FIG. 32]

According to Embodiment 4, the amount of air of the abnormal cylinder is corrected so as to decrease, the air-fuel ratio of the abnormal cylinder is corrected to the rich side, and when the torque of the abnormal cylinder after the correction is smaller than torque of the cylinders other than the abnormal cylinder, ignition timing of the abnormal cylinder is corrected to an advance angle side.

FIG. 30 is a control system diagram illustrating a control apparatus 1D according to Embodiments 4, 8.

Present Embodiment 4 is different from above described Embodiment 3 in the specification of the cylinder-specific air amount correction value calculation section 166. Furthermore, Embodiment 4 is different from Embodiment 3 in that there is no section corresponding to the cylinder-specific fuel injection amount correction value calculation section 165 of Embodiment 3 and a cylinder-specific ignition timing correction value calculation section 311 is newly provided. Since other means have configurations substantially the same as those of Embodiment 3, parts different from those in Embodiment 3 will be described with emphasis placed thereon.

In Embodiment 4, the following processes will be performed.

Stage 1 (f_stage=1)

(1) A variance of angular acceleration is calculated for each cylinder and a cylinder having the largest variance of angular acceleration (leanest cylinder) is detected as an abnormal cylinder (Cyl_Mal). Assume a variance of angular acceleration of the cylinder of cylinder number Cyl_Mal, that is, the abnormal cylinder is V_omega_Cyl_Mal.

(2) An amount of air of the leanest cylinder (abnormal cylinder) is corrected so as to decrease (IVO_Hos_n, IVC_Hos_n) based on V_omega_Cyl_Mal.

Stage 2 (f_stage=2)

(1) Performed after stage 1 ends.

(2) An average value of angular acceleration is calculated for each cylinder and when the cylinder number having the smallest average value of angular acceleration matches cylinder number Cyl_Mal of the abnormal cylinder, the average value of angular acceleration of the cylinder (abnormal cylinder) is assumed to be M_omega_Cyl_Mal.

(3) Ignition timing of the cylinder (abnormal cylinder) is corrected to an advance angle side (ADV_Hos_n) based on M_omega_Cyl_Mal.

Hereinafter, the cylinder-specific ignition timing correction value calculation section 311 and the cylinder-specific air amount correction value calculation section 166 will be described in detail.

<Cylinder-Specific Ignition Timing Correction Value Calculation Section (FIG. 31)>

FIG. 31 is a block diagram illustrating functions of the cylinder-specific ignition timing correction value calculation section (Embodiments 4, 8).

The cylinder-specific ignition timing correction value calculation section 311 shown in FIG. 30 calculates a cylinder-specific ignition timing correction value (ADV_Hos_n (n is a cylinder number)) based on the angular acceleration characteristic obtained by the aforementioned cylinder-specific angular acceleration characteristic calculation section 164. To be more specific, as shown in FIG. 31, when f_stage=2 and fp_hosei=1, the following processing will be performed.

- Only an ignition timing correction value whose cylinder number is Cyl_Mal (abnormal cylinder number) is assumed to be a value calculated by this control section. Assume ADV_Hos_n of other cylinders is 0.
- With reference to a table (Tbl_M_omega_ADV) 321 from M_omega_Cyl_Mal, assume ADV_Hos_n (cylinder-specific ignition timing correction value) of the cylinder to be corrected (whose cylinder number is Cyl_Mal). The set value of Tbl_M_omega_ADV indicates a relationship between an average value of angular acceleration and an ignition timing advance angle, and may be preferably determined from a result of a test using an actual machine.

<Cylinder-Specific Air Amount Correction Value Calculation Section (FIG. 32)>

FIG. 32 is a block diagram illustrating functions of the cylinder-specific air amount correction value calculation section (Embodiment 4).

The cylinder-specific air amount correction value calculation section 166 shown in FIG. 30 calculates a cylinder-specific air amount correction value (IVO_Hos_n, IVC_Hos (n is a cylinder number)) based on the angular acceleration characteristic obtained by the aforementioned cylinder-specific angular acceleration characteristic calculation section 164. To be more specific, as shown in FIG. 32, when f_stage=1 and fp_hosei=1, the following processing will be performed.

(1) Only the air amount correction value whose cylinder number is Cyl_Mal (abnormal cylinder number) is assumed to be a value calculated by this calculation section. IVO_Hos_n and IVC_Hos_n of other cylinders are assumed to be 0.

(2) With reference to a table (Tbl_V_omega_IVO) 331 from V_omega_Cyl_Mal, assume IVO_Hos_n of the cylinder to be corrected (whose cylinder number is Cyl_Mal).

(3) With reference to a table (Tbl_V_omega_IVC) 332 from V_omega_Cyl_Mal, assume IVC_Hos_n of the cylinder to be corrected (whose cylinder number is Cyl_Mal). The set values of Tbl_V_omega_IVO_Hos and Tbl_V_omega_IVC_Hos indicate a relationship between a variance of angular acceleration and an air-fuel ratio, and may be preferably determined from a result of a test using an actual machine.

The control apparatus 1D according to Embodiment 4 corrects the amount of air of the abnormal cylinder so as to decrease and corrects the air-fuel ratio of the abnormal cylinder to the rich side. After correcting the air-fuel ratio of the abnormal cylinder to the rich side by air amount decreasing correction, the control apparatus 1D compares angular acceleration of the abnormal cylinder subjected to the air amount decreasing correction or an average value thereof with angular acceleration of the cylinders other than the abnormal cylinder or an average value thereof, and judges, when the angular acceleration of the abnormal cylinder or an average value thereof is smaller than the angular acceleration of the cylinders other than the abnormal cylinder or an average value thereof, that the amount of fuel of the abnormal cylinder is smaller than the amount of fuel of the cylinders other than the abnormal cylinder. That is, after correcting the abnormal cylinder by decreasing the amount of air, the control apparatus 1D compares the angular acceleration of the abnormal cylinder or an average value thereof with the angular acceleration of the cylinders other than the abnormal cylinder or an average value thereof again.

In this case, when the cause of the leanness of the abnormal cylinder is an unintended decrease of the amount of fuel, although the air-fuel ratio of the abnormal cylinder is modified (converged to the vicinity of the target air-fuel ratio) by air amount decreasing correction, the amount of fuel supplied is smaller than that of the cylinders other than the abnormal cylinder, and therefore the torque generated is smaller. That is, angular acceleration generated upon combustion of the abnormal cylinder is smaller than angular acceleration generated upon combustion of the cylinders other than the abnormal cylinder.

Therefore, when the angular acceleration of the abnormal cylinder or an average value thereof is smaller than the angular acceleration of the cylinders other than the abnormal cylinder or an average value thereof, it is possible to judge that the amount of fuel of the abnormal cylinder is smaller than the amount of fuel of the cylinders other than the abnormal cylinder.

Ignition timing of the abnormal cylinder judged to have a smaller amount of fuel is corrected to an advance angle side. That is, to eliminate the difference between the torque generated of the abnormal cylinder judged to have the smaller amount of fuel and the torque generated of the cylinders other than the abnormal cylinder, ignition timing of the abnormal cylinder is corrected to an advance angle side. As a result, it is possible to eliminate variations in the air-fuel ratio and torque between the abnormal cylinder and the cylinders other than the abnormal cylinder.

Figure 33:
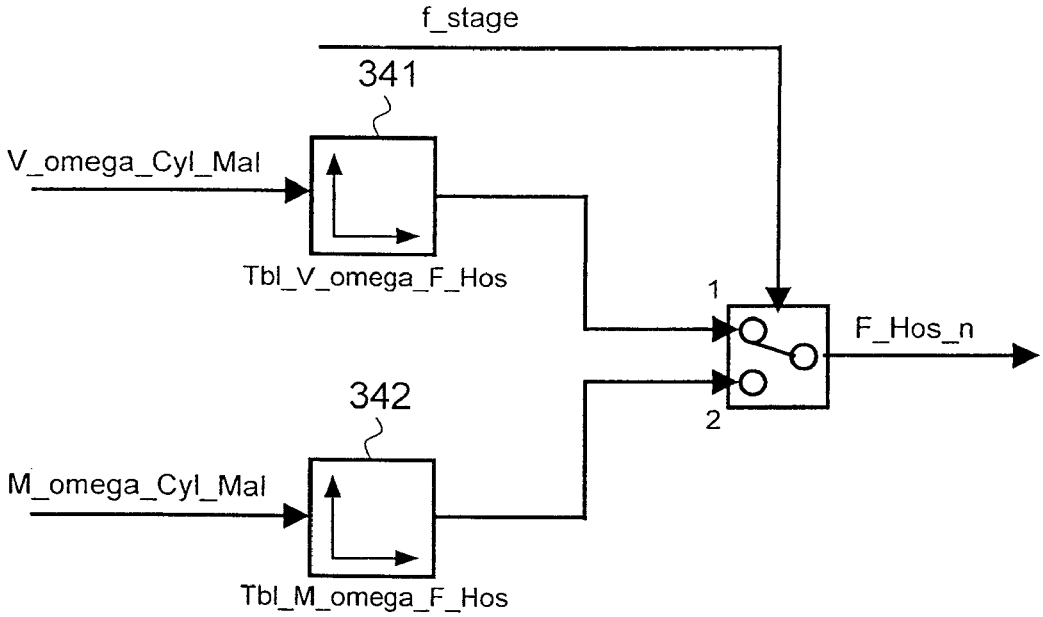
FIG. 33 is a diagram illustrating the cylinder-specific fuel injection amount correction value calculation section according to Embodiment 5.

[Embodiment 5: FIG. 33]

In Embodiment 5, an amount of fuel of the cylinders other than the abnormal cylinder is corrected so as to decrease, the air-fuel ratios of the cylinders other than the abnormal cylinder are corrected to the lean side, and when torque of the abnormal cylinder after the correction is greater than torque of the cylinders other than the abnormal cylinder, the amount of fuel and amount of air of the abnormal cylinder are corrected so as to decrease.

Present Embodiment 5 is different from above described Embodiment 1 only in the specification of the cylinder-specific fuel injection amount correction value calculation section 165 and other means are substantially the same, and therefore the calculation sections of different specifications will be described with emphasis placed thereon below.

In Embodiment 5, the following processes will be performed.

Stage 1 (f_stage=1)

(1) A variance of angular acceleration is calculated for each cylinder and a cylinder having the largest variance of angular acceleration (leanest cylinder: lean cylinder) is detected as an abnormal cylinder (Cyl_Mal). A variance of angular acceleration of a cylinder of cylinder number Cyl_Mal, that is, the abnormal cylinder is assumed to be V_omega_Cyl_Mal.

(2) For cylinders other than the leanest cylinder (abnormal cylinder), a fuel injection amount is corrected so as to decrease (F_Hos_n) based on V_omega_Cyl_Mal.

Stage 2 (f_stage=2)

(1) Performed after stage 1 ends.

(2) An average value of angular acceleration is calculated for each cylinder, and when the cylinder number of a cylinder having the largest average value of angular acceleration matches Cyl_Mal (cylinder number of the abnormal cylinder), the average value of angular acceleration of the cylinder (abnormal cylinder) is assumed to be M_omega_Cyl_Mal (average value of angular acceleration of the abnormal cylinder).

(3) The fuel injection amount and the amount of air of the cylinder (abnormal cylinder) are corrected so as to decrease (F_Hos_n, IVO_Hos_n, IVC_Hos_n) based on M_omega_Cyl_Mal.

Hereinafter, the cylinder-specific fuel injection amount correction value calculation section 165 according to present Embodiment 5 will be described in detail.

<Cylinder-Specific Fuel Injection Amount Correction Value Calculation Section (FIG. 33)>

FIG. 33 is a block diagram illustrating functions of the cylinder-specific fuel injection amount correction value calculation section according to Embodiment 5. This calculation section calculates a cylinder-specific fuel injection amount correction value (F_Hos_n (n is a cylinder number)) based on the angular acceleration characteristic obtained by the above described cylinder-specific angular acceleration characteristic calculation section 164. To be more specific, as shown in FIG. 33, when fp_hosei (Correction Permission flag)=1, the following processing will be performed.

When stage 1 (when f_stage=1)

(1) Only the fuel injection amount correction value of a cylinder whose cylinder number is other than Cyl_Mal is assumed to be a value calculated by this calculation section. F_Hos_n of a cylinder whose cylinder number is Cyl_Mal is assumed to be 1.0.

(2) With reference to a table (Tbl_V_omega_F_Hos) 341 from V_omega_Cyl_Mal, assume F_Hos_n of the cylinder to be corrected (cylinder whose cylinder number is other than Cyl_Mal).

When stage 2 (when f_stage=2)

(1) Only the fuel injection amount correction value of a cylinder whose cylinder number is other than Cyl_Mal is assumed to be a value calculated by this calculation section. F_Hos_n of other cylinders is assumed to be 1.0.

(2) With reference to a table (Tbl_M_omega_F_Hos) 342 from M_omega_Cyl_Mal, assume F_Hos_n of the cylinder to be corrected (whose cylinder number is Cyl_Mal).

The set value of Tbl_V_omega_F_Hos indicates a relationship between a variance of angular acceleration and an air-fuel ratio, and may be preferably determined from a result of a test using an actual machine. The set value of Tbl_M_omega_F_Hos indicates a relationship between an average value of angular acceleration and torque (fuel injection amount corresponding to filling efficiency), and may be preferably determined from a result of a test using an actual machine. That is, when the angular acceleration average value of the cylinder of cylinder number Cyl_Mal is greater than the angular acceleration average value of the other cylinders, correction by this calculation section is performed. Since the magnitude of angular acceleration has a correlation with the magnitude of torque of the cylinder, the amount of fuel of the cylinder is reduced so that the torque of the cylinder of cylinder number Cyl_Mal becomes equal to that of the other cylinders.

When only the amount of fuel is reduced, the abnormal cylinder becomes lean, and therefore, the above described cylinder-specific air amount correction value calculation section 166 also reduces the amount of air of the abnormal cylinder (filling efficiency) together.

The control apparatus 1A according to Embodiment 5 corrects the amount of fuel of the cylinders other than the abnormal cylinder so as to decrease and corrects the air-fuel ratios of the cylinders other than the abnormal cylinder to the lean side.

In this case, the air-fuel ratio (average air-fuel ratio of all the cylinders) of the exhaust manifold temporarily shifts to the lean side due to the influence that the air-fuel ratios of the cylinders other than the abnormal cylinder are corrected to the lean side, and therefore the air-fuel ratio feedback control functions so that all the cylinders are uniformly corrected to the rich side, and as a result, the air-fuel ratios of all the cylinders are controlled to the vicinity of the target air-fuel ratio.

When attention is focused on a specific cylinder from among the plurality of cylinders, the air-fuel ratio does not always shift to the lean side, but even if the air-fuel ratio shifts to the rich side, the air-fuel ratios of the other cylinders shift to the lean side by air-fuel ratio feedback control, and therefore an abnormal cylinder is generated anyway. Furthermore, by frequently performing this control, it is possible to successively correct only a cylinder which becomes leanest as an abnormal cylinder, and consequently always suppress variations in the air-fuel ratios of all the cylinders.

After correcting the air-fuel ratios of the cylinders other than the abnormal cylinder to the lean side by fuel amount decreasing correction, the control apparatus 1A compares angular acceleration of the abnormal cylinder or an average value thereof with angular acceleration of the cylinders other than the abnormal cylinder or an average value thereof and judges, when the angular acceleration of the abnormal cylinder or an average value thereof is greater than the angular acceleration of the cylinders other than the abnormal cylinder or an average value thereof, that the amount of air of the abnormal cylinder is greater than the amount of air of the cylinders other than the abnormal cylinder. That is, the control apparatus 1A corrects the cylinders other than the abnormal cylinder by decreasing the amount of fuel and then compares angular acceleration of the abnormal cylinder or an average value thereof with angular acceleration of the cylinders other than the abnormal cylinder or an average value thereof again.

In this case, when the cause of the leanness of the abnormal cylinder is an unintended increase of the amount of air, the cylinders other than the abnormal cylinder are subjected to fuel amount decreasing correction, and air-fuel ratio feedback control causes fuel amount increasing (to the rich side) correction to uniformly function on all the cylinders, and the air-fuel ratio of the abnormal cylinder is also corrected to the rich side and modified (converged to the vicinity of the target air-fuel ratio).

However, as a result, the abnormal cylinder has a greater amount of fuel supplied than the cylinders other than the abnormal cylinder and the torque generated is thereby greater. That is, angular acceleration generated upon combustion of the abnormal cylinder is greater than angular acceleration generated upon combustion of the cylinders other than the abnormal cylinder.

Therefore, when angular acceleration of the abnormal cylinder or an average value thereof is greater than angular acceleration of the cylinders other than the abnormal cylinder or an average value thereof, it is possible to judge that the amount of air of the abnormal cylinder is greater than the amount of air of the cylinders other than the abnormal cylinder.

Correction is then made so as to decrease the amount of air and the amount of fuel of the abnormal cylinder judged to have the greater amount of air. That is, to eliminate the difference between the torque generated of the abnormal cylinder judged to have the greater amount of air and the torque generated of the cylinders other than the abnormal cylinder, correction is made so as to decrease the amount of air of the abnormal cylinder which is the cause of the difference.

In this case, the amount of fuel is also corrected according to the decrease in the amount of air so that the air-fuel ratio of the abnormal cylinder does not become rich. As a result, it is possible to eliminate variations in the air-fuel ratio and torque between the abnormal cylinder and the cylinders other than the abnormal cylinder.

Figure 34:
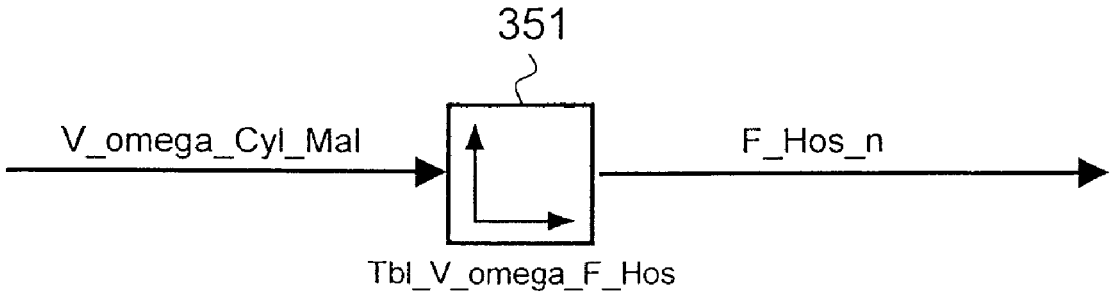
FIG. 34 is a diagram illustrating the cylinder-specific fuel injection amount correction value calculation section according to Embodiment 6.

[Embodiment 6: FIG. 34]

In Embodiment 6, the amount of fuel of the cylinders other than the abnormal cylinder is corrected so as to decrease, the air-fuel ratios of the cylinders other than the abnormal cylinder are corrected to the lean side, and when the torque of the abnormal cylinder after the correction is greater than the torque of the cylinders other than the abnormal cylinder, ignition timing of the abnormal cylinder is corrected so as to retard.

Present Embodiment 6 is different from above described Embodiment 1 only in the specification of the cylinder-specific fuel injection amount correction value calculation section 165, and other means are substantially the same, and therefore only calculation sections having different specifications will be described with emphasis placed thereon.

In Embodiment 6, the following processes will be performed.

Stage 1 (f_stage=1)

(1) A variance of angular acceleration is calculated for each cylinder, and a cylinder having the largest variance of angular acceleration (leanest cylinder: lean cylinder) is detected as an abnormal cylinder (Cyl_Mal). A variance of angular acceleration of a cylinder of cylinder number Cyl_Mal, that is, the abnormal cylinder is assumed to be V_omega_Cyl_Mal.

(2) A fuel injection amount is corrected so as to decrease (F_Hos_n) for cylinders other than the leanest cylinder (abnormal cylinder) based on V_omega_Cyl_Mal.

Stage 2 (f_stage=2)

(1) Performed after stage 1 ends.

(2) An average value of angular acceleration is calculated for each cylinder, and when a cylinder number of a cylinder having the largest average value of angular acceleration matches Cyl_Mal (cylinder number of the abnormal cylinder), the average value of angular acceleration of the cylinder (abnormal cylinder) is assumed to be M_omega_Cyl_Mal (average value of angular acceleration of the abnormal cylinder).

(3) Ignition timing of the cylinder (abnormal cylinder) is corrected to the retarding side (ADV_Hos_n) based on M_omega_Cyl_Mal.

Hereinafter, the cylinder-specific fuel injection amount correction value calculation section 165 according to present Embodiment 6 will be described in detail.

<Cylinder-Specific Fuel Injection Amount Correction Value Calculation Section (FIG. 34)>

FIG. 34 is a block diagram illustrating functions of the cylinder-specific fuel injection amount correction value calculation section according to Embodiment 6. This calculation section calculates a cylinder-specific fuel injection amount correction value (F_Hos_n (n is a cylinder number)) based on the angular acceleration characteristic obtained by the above described cylinder-specific angular acceleration characteristic calculation section 164. To be more specific, as shown in FIG. 34, when f_stage=1 and fp_hosei=1, the following processing will be performed.

Only the fuel injection amount correction value of a cylinder whose cylinder number is other than Cyl_Mal is assumed to be a value calculated by this calculation section. F_Hos_n of a cylinder whose cylinder number is Cyl_Mal is assumed to be 1.0.

With reference to a table (Tbl_V_omega_F_Hos) 351 from V_omega_Cyl_Mal, assume F_Hos_n of the cylinder to be corrected (cylinder whose cylinder number is other than Cyl_Mal).

The set value of Tbl_V_omega_F_Hos indicates a relationship between a variance of angular acceleration and an air-fuel ratio, and may be preferably determined from a result of a test using an actual machine.

The control apparatus 1B according to Embodiment 6 corrects the amount of fuel of the cylinders other than the abnormal cylinder so as to decrease and corrects the air-fuel ratios of the cylinders other than the abnormal cylinder to the lean side. After correcting the air-fuel ratios of the cylinders other than the abnormal cylinder to the lean side by fuel amount decreasing correction, the control apparatus 1B compares angular acceleration of the abnormal cylinder or an average value thereof with angular acceleration of the cylinders other than the abnormal cylinder or an average value thereof, and judges, when the angular acceleration of the abnormal cylinder or an average value thereof is greater than the angular acceleration of the cylinders other than the abnormal cylinder or an average value thereof, that the amount of air of the abnormal cylinder is greater than the amount of air of the cylinders other than the abnormal cylinder. That is, after correcting the cylinders other than the abnormal cylinder by decreasing the amount of fuel, the control apparatus 1B compares angular acceleration of the abnormal cylinder or an average value thereof with angular acceleration of the cylinders other than the abnormal cylinder or an average value thereof again.

In this case, when the cause of the leanness of the abnormal cylinder is an unintended increase of the amount of air, the cylinders other than the abnormal cylinder are subjected to fuel amount decreasing correction, and air-fuel ratio feedback control thereby functions to uniformly correct all the cylinders to increase an amount of fuel (to the rich side), and the air-fuel ratio of the abnormal cylinder is also corrected to the rich side and modified (converged to the vicinity of the target air-fuel ratio).

However, as a result, the abnormal cylinder has a greater amount of fuel supplied than that of the cylinders other than the abnormal cylinder, and so the torque generated is greater. That is, angular acceleration generated upon combustion of the abnormal cylinder is greater than angular acceleration generated upon combustion of the cylinders other than the abnormal cylinder.

Therefore, when angular acceleration of the abnormal cylinder or an average value thereof is greater than angular acceleration of the cylinders other than the abnormal cylinder or an average value thereof, it is possible to judge that the amount of air of the abnormal cylinder is greater than the amount of air of the cylinders other than the abnormal cylinder.

Ignition timing of the abnormal cylinder judged to have a greater amount of air is then corrected to the retarding side. That is, to eliminate the difference between the torque generated of the abnormal cylinder judged to have the greater amount of air and the torque generated of the cylinders other than the abnormal cylinder, ignition timing of the abnormal cylinder is corrected to the retarding side. As a result, it is possible to eliminate variations in the air-fuel ratio and torque between the abnormal cylinder and the cylinders other than the abnormal cylinder.

Figure 35:
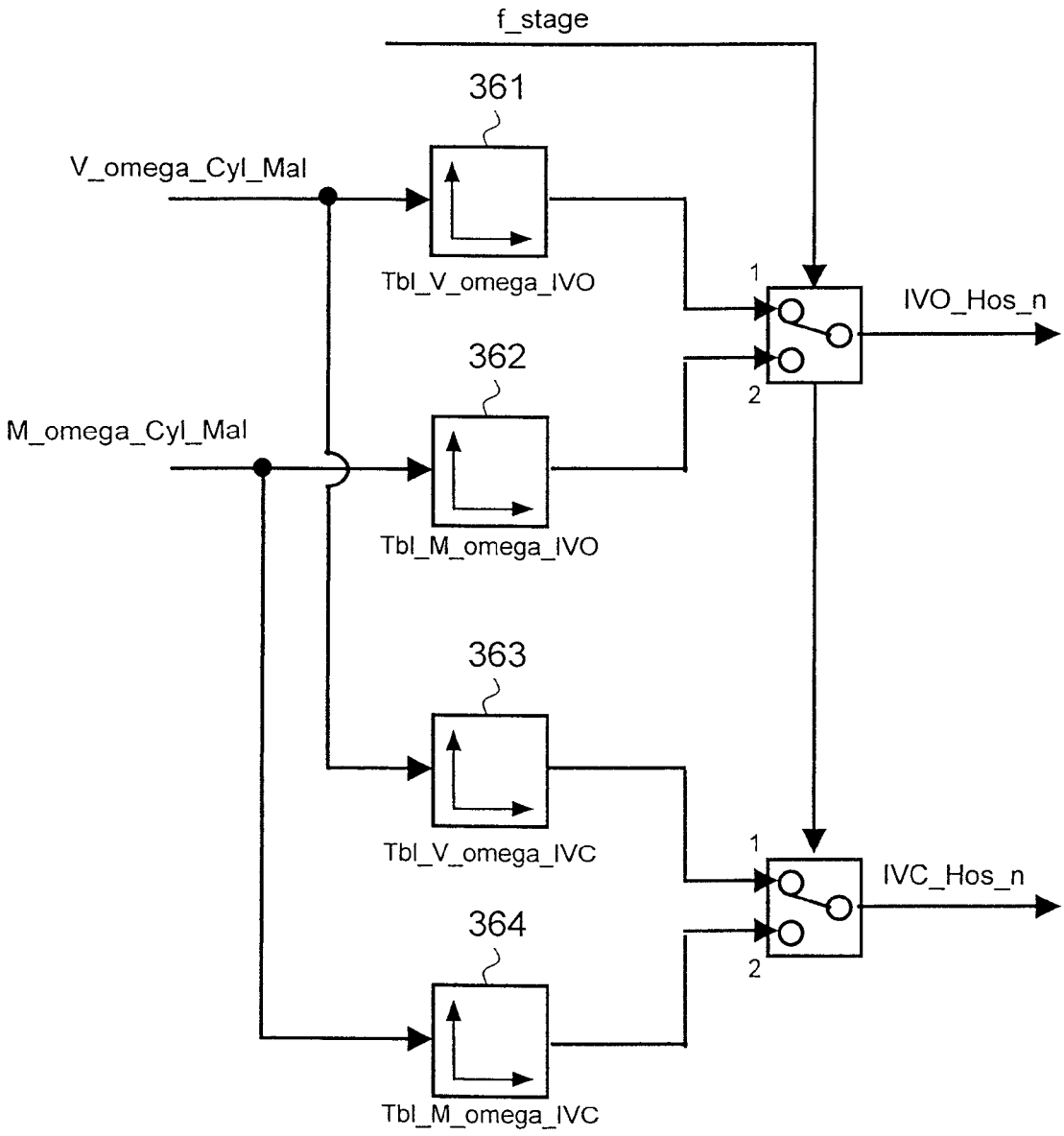
FIG. 35 is a diagram illustrating the cylinder-specific air amount correction value calculation section according to Embodiment 7.

[Embodiment 7: FIG. 35]

In Embodiment 7, the amount of air of the cylinders other than the abnormal cylinder is corrected so as to increase, the air-fuel ratios of the cylinders other than the abnormal cylinder are corrected to the lean side, and when torque of the abnormal cylinder after the correction is smaller than torque of the cylinders other than the abnormal cylinder, the amount of fuel and amount of air of the abnormal cylinder are corrected so as to increase.

Present Embodiment 7 is only different from above described Embodiment 3 in the specification of the cylinder-specific air amount correction value calculation section 166 and other means are substantially the same, and therefore calculation sections having different specifications will be described with emphasis placed thereon below.

In Embodiment 7, the following processes will be performed.

Stage 1 (f_stage=1)

(1) A variance of angular acceleration is calculated for each cylinder and a cylinder having the largest variance of angular acceleration (leanest cylinder: lean cylinder) is detected as an abnormal cylinder (Cyl_Mal). The variance of angular acceleration of a cylinder of cylinder number Cyl_Mal, that is, the abnormal cylinder is assumed to be V_omega_Cyl_Mal.

(2) The amount of air of the cylinders other than the leanest cylinder (abnormal cylinder) is corrected so as to increase (IVO_Hos_n, IVC_Hos_n) based on V_omega_Cyl_Mal.

Stage 2 (f_stage=2)

(1) Performed after stage 1 ends.

(2) An average value of angular acceleration is calculated for each cylinder and when a cylinder number having the smallest average value of angular acceleration matches cylinder number Cyl_Mal of the abnormal cylinder, the average value of angular acceleration of the cylinder (abnormal cylinder) is assumed to be M_omega_Cyl_Mal (average value of angular acceleration of the abnormal cylinder).

(3) A fuel injection amount and amount of air of the cylinder (abnormal cylinder) are corrected so as to increase (F_Hos_n, IVO_Hos_n, IVC_Hos_n) based on M_omega_Cyl_Mal.

Hereinafter, the cylinder-specific air amount correction value calculation section 166 according to present Embodiment 7 will be described in detail.

<Cylinder-Specific Air Amount Correction Value Calculation Section (FIG. 35)>

FIG. 35 is a block diagram illustrating functions of the cylinder-specific air amount correction value calculation section according to Embodiment 7. This calculation section calculates a cylinder-specific air amount correction value (IVO_Hos_n, IVC_Hos (n is a cylinder number)) based on the angular acceleration characteristic obtained by the above described cylinder-specific angular acceleration characteristic calculation section 164. To be more specific, as shown in FIG. 35, when fp_hosei=1, the following processing will be performed.

When stage 1 (when f_stage=1)

(1) Only an air amount correction value of a cylinder whose cylinder number is other than Cyl_Mal is assumed to be a value calculated by this calculation section. IVO_Hos_n and IVC_Hos_n of the cylinder whose cylinder number is Cyl_Mal are assumed to be 0.

(2) With reference to a table (Tbl_V_omega_IVO) 361 from V_omega_Cyl_Mal, assume IVO_Hos_n of the cylinder to be corrected (whose cylinder number is Cyl_Mal).

(3) With reference to a table (Tbl_V_omega_IVC) 363 from V_omega_Cyl_Mal, assume IVC_Hos_n of the cylinder to be corrected (whose cylinder number is Cyl_Mal).

When stage 2 (when f_stage=2)

(1) Only the air amount correction value having a cylinder number of Cyl_Mal is assumed to be a value calculated by this calculation section. IVO_Hos_n and IVC_Hos_n of other cylinders are assumed to be 0.

(2) With reference to a table (Tbl_M_omega_IVO) 362 from M_omega_Cyl_Mal, assume IVO_Hos_n of the cylinder to be corrected (whose cylinder number is Cyl_Mal).

(3) With reference to a table (Tbl_M_omega_IVC) 364 from M_omega_Cyl_Mal, assume IVC_Hos_n of the cylinder to be corrected (whose cylinder number is Cyl_Mal).

The set values of Tbl_V_omega_IVO_Hos and Tbl_V_omega_IVC_Hos indicate a relationship between the variance of angular acceleration and the air-fuel ratio, and may be preferably determined from a result of a test using an actual machine. The set values of Tbl_M_omega_IVO_Hos and Tbl_M_omega_IVC_Hos indicate a relationship between the average value of angular acceleration and torque (filling efficiency), and may be preferably determined from a result of a test using an actual machine. That is, when the angular acceleration average value of the cylinder of cylinder number Cyl_Mal is smaller than the angular acceleration average value of the other cylinders, correction by this calculation section is performed.

Since the magnitude of angular acceleration has a correlation with the magnitude of torque of the cylinder (abnormal cylinder), the amount of air (filling efficiency) of the cylinder (abnormal cylinder) is increased so that the torque of the cylinder of cylinder number Cyl_Mal (abnormal cylinder) is the same as that of the other cylinders (cylinders other than the abnormal cylinder). When only the amount of air is increased, the cylinder (abnormal cylinder) becomes lean, and therefore the aforementioned cylinder-specific fuel correction amount value calculation section 272 also increases the amount of fuel of the cylinder (abnormal cylinder) together.

The control apparatus 1C according to Embodiment 7 corrects the amount of air of the cylinders other than the abnormal cylinder so as to increase and corrects the air-fuel ratios of the cylinders other than the abnormal cylinder to the lean side. After correcting the air-fuel ratios of the cylinders other than the abnormal cylinder to the lean side by air a mount increasing correction, the control apparatus 1C compares angular acceleration of the abnormal cylinder or an average value thereof with angular acceleration of the cylinders other than the abnormal cylinder or an average value thereof, and judges, when angular acceleration of the abnormal cylinder or an average value thereof is smaller than angular acceleration of the cylinders other than the abnormal cylinder or an average value thereof, that the amount of fuel of the abnormal cylinder is smaller than the amount of fuel of the cylinders other than the abnormal cylinder. That is, after correcting the cylinders other than the abnormal cylinder by increasing the amount of air, the control apparatus 1C compares angular acceleration of the abnormal cylinder or an average value thereof with angular acceleration of the cylinders other than the abnormal cylinder or an average value thereof again.

In this case, when the cause of the leanness of the abnormal cylinder is an unintended decrease of the amount of fuel, the cylinders other than the abnormal cylinder are subjected to air amount increasing correction, the air-fuel ratio feedback control functions so that all the cylinders are uniformly corrected so as to increase (to the rich side) and the air-fuel ratio of the abnormal cylinder is also corrected to the rich side and modified (converged to the vicinity of the target air-fuel ratio).

However, as a result, since the abnormal cylinder still has a smaller amount of fuel supplied than the cylinders other than the abnormal cylinder, the torque generated is smaller. That is, angular acceleration generated upon combustion of the abnormal cylinder is smaller that angular acceleration generated upon combustion of the cylinders other than the abnormal cylinder.

Therefore, when angular acceleration of the abnormal cylinder or an average value thereof is smaller than angular acceleration of the cylinders other than the abnormal cylinder or an average value thereof, it is possible to judge that the amount of fuel of the abnormal cylinder is smaller than the amount of fuel of the cylinders other than the abnormal cylinder.

The abnormal cylinder whose amount of fuel is judged to be smaller is corrected so as to increase the amount of air and amount of fuel. That is, to eliminate the difference between the torque generated of the abnormal cylinder judged to have the smaller amount of fuel and the torque generated of the cylinders other than the abnormal cylinder, correction is made so as to increase the amount of fuel of the abnormal cylinder which is the cause of the difference. In this case, the amount of air is also increased according to the increase in the amount of fuel so that the air-fuel ratio of the abnormal cylinder does not become rich. As a result, it is possible to eliminate variations in the air-fuel ratio and torque between the abnormal cylinder and the cylinders other than the abnormal cylinder.

Figure 36:
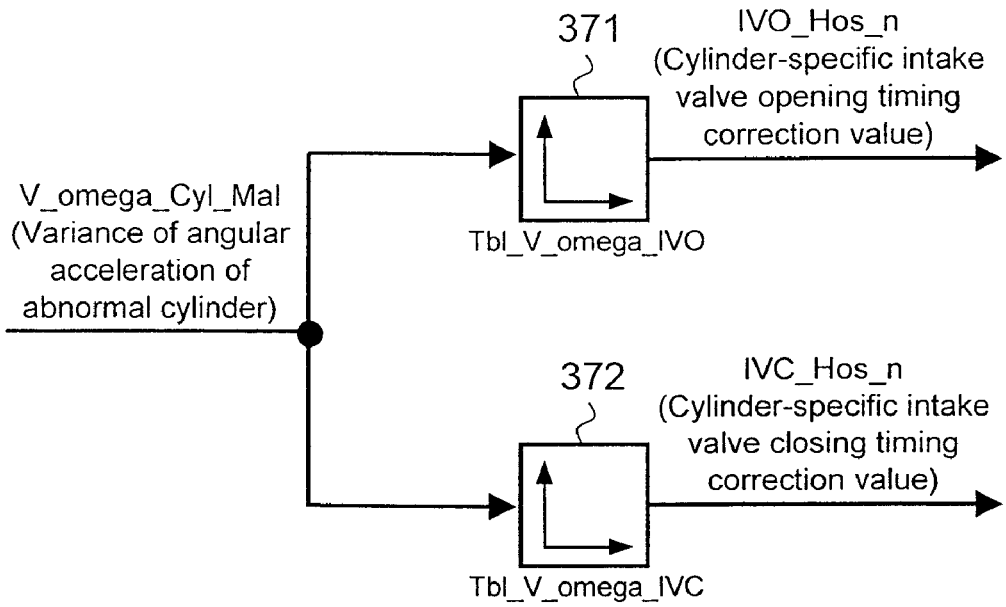
FIG. 36 is a diagram illustrating the cylinder-specific air amount correction value calculation section according to Embodiment 8.

[Embodiment 8: FIG. 36]

In Embodiment 8, the amount of air of cylinders other than an abnormal cylinder is corrected so as to increase, the air-fuel ratios of the cylinders other than the abnormal cylinder are corrected to the lean side, and when the torque of the abnormal cylinder after the correction is smaller than the torque of the cylinders other than the abnormal cylinder, ignition timing of the abnormal cylinder is corrected to an advance angle side.

Present Embodiment 8 is different from above described Embodiment 4 only in the specification of the cylinder-specific air amount correction value calculation section 166 and other means are substantially the same, and therefore calculation sections having different specifications will be described with emphasis placed thereon below.

In Embodiment 8, the following processes will be performed.

Stage 1 (f_stage=1)

(1) A variance of angular acceleration is calculated for each cylinder and a cylinder having the largest variance of angular acceleration (leanest cylinder: lean cylinder) is detected as an abnormal cylinder (Cyl_Mal). A variance of angular acceleration of a cylinder of cylinder number Cyl_Mal, that is, the abnormal cylinder is assumed to be V_omega_Cyl_Mal.

(2) The amount of air of the cylinders other than the leanest cylinder (abnormal cylinder) is corrected so as to increase (IVO-Hos_n, IVC_Hos_n) based on V_omega_Cyl_Mal.

Stage 2 (f_stage=2)

(1) Performed after stage 1 ends.

(2) An average value of angular acceleration is calculated for each cylinder, and when a cylinder number having the smallest average value of angular acceleration matches cylinder number Cyl_Mal of the abnormal cylinder, the average value of angular acceleration of the cylinder (abnormal cylinder) is assumed to be M_omega_Cyl_Mal (average value of angular acceleration of the abnormal cylinder).

(3) Ignition timing of the cylinder (abnormal cylinder) is corrected to an advance angle side (ADV_Hos_n) based on M_omega_Cyl_Mal.

Hereinafter, the cylinder-specific air amount correction value calculation section 166 according to present Embodiment 8 will be described in detail.

<Cylinder-Specific Air Amount Correction Value Calculation Section (FIG. 36)>

FIG. 36 is a block diagram illustrating functions of the cylinder-specific air amount correction value calculation section 166 according to Embodiment 8. This calculation section calculates a cylinder-specific air amount correction value (IVO_Hos_n, IVC_Hos (n is a cylinder number) based on the angular acceleration characteristic obtained by the above described cylinder-specific angular acceleration characteristic calculation section 164. To be more specific, as shown in FIG. 36, when f_stage=1 and fp_hosei=1, the following processing will be performed.

(1) Only the air amount correction value of a cylinder whose cylinder number is other than Cyl_Mal is assumed to be a value calculated by this calculation section. IVO_Hos_n and IVC_Hos_n of the cylinder whose cylinder number is Cyl_Mal are assumed to be 0.

(2) With reference to a table (Tbl_V_omega_IVO) 371 from V_omega_Cyl_Mal, assume IVO_Hos_n of the cylinder to be corrected (whose cylinder number is Cyl_Mal).

(3) With reference to a table (Tbl_V_omega_IVC) 372 from V_omega_Cyl_Mal, assume IVC_Hos_n of the cylinder to be corrected (whose cylinder number is Cyl_Mal).

The set values of Tbl_V_omega_IVO_Hos and Tbl_V_omega_VC_Hos indicate a relationship between a variance of angular acceleration and an air-fuel ratio, and may be preferably determined from a result of a test using an actual machine.

The control apparatus 1D according to Embodiment 8 corrects the amount of air of the cylinders other than the abnormal cylinder so as to increase and corrects the air-fuel ratios of the cylinders other than the abnormal cylinder to the lean side. After correcting the air-fuel ratios of the cylinders other than the abnormal cylinder to the lean side by air amount increasing correction, the control apparatus 1D compares angular acceleration of the abnormal cylinder or an average value thereof with angular acceleration of the cylinders other than the abnormal cylinder or an average value thereof, and judges, when angular acceleration of the abnormal cylinder or an average value thereof is smaller than angular acceleration of the cylinders other than the abnormal cylinder or an average value thereof, that the amount of fuel of the abnormal cylinder is smaller than the amount of fuel of the cylinders other than the abnormal cylinder. That is, after correcting the cylinders other than the abnormal cylinder by increasing the amount of air, the control apparatus 1D compares angular acceleration of the abnormal cylinder or an average value thereof with angular acceleration of the cylinders other than the abnormal cylinder or an average value thereof again.

In this case, when the cause of the leanness of the abnormal cylinder is an unintended decrease of the amount of fuel, the cylinders other than the abnormal cylinder are subjected to air amount increasing correction and the air-fuel ratio feedback control functions so that all the cylinders are uniformly corrected so as to increase the amount of fuel (to the rich side) and the air-fuel ratio of the abnormal cylinder is also corrected to the rich side and modified (converged to the vicinity of the target air-fuel ratio).

However, as a result, since the abnormal cylinder still has a smaller amount of fuel supplied than the cylinders other than the abnormal cylinder, the torque generated is smaller. That is, angular acceleration generated upon combustion of the abnormal cylinder is smaller than angular acceleration generated upon combustion of the cylinders other than the abnormal cylinder.

Therefore, when angular acceleration of the abnormal cylinder or an average value thereof is smaller than angular acceleration of the cylinders other than the abnormal cylinder or an average value thereof, it is possible to judge that the amount of fuel of the abnormal cylinder is smaller than the amount of fuel of the cylinders other than the abnormal cylinder.

Ignition timing of the abnormal cylinder whose amount of fuel is judged to be small is corrected to an advance angle side. That is, to eliminate the difference between the torque generated of the abnormal cylinder judged to have a smaller amount of fuel and the torque generated of the cylinders other than the abnormal cylinder, ignition timing of the abnormal cylinder is corrected to an advance angle side. As a result, it is possible to eliminate variations in the air-fuel ratio and torque between the abnormal cylinder and the cylinders other than the abnormal cylinder.

What is claimed is:

1. An engine control apparatus provided with a plurality of cylinders, comprising:

means for performing feedback control of an air-fuel ratio based on a real air-fuel ratio of an exhaust manifold that communicates with each of the cylinders;

means for judging that a difference between a target air-fuel ratio and the real air-fuel ratio is equal to or below a predetermined value during the air-fuel ratio feedback control;

means for detecting a cylinder having a largest variation of angular acceleration of a crank shaft of the plurality of cylinders when the difference between the target air-fuel ratio and the real air-fuel ratio is judged to be equal to or below the predetermined value;

means for correcting the air-fuel ratio of the cylinder having the largest variation of angular acceleration to a rich side or correcting the air-fuel ratio of a cylinder other than the cylinder having the largest variation of angular acceleration to a lean side;

means for comparing angular acceleration of the cylinder having the largest variation of angular acceleration or an average value thereof with angular acceleration of the cylinder other than the cylinder having the largest variation of angular acceleration or an average value thereof, and judging, when angular acceleration of the cylinder having the largest variation of angular acceleration or an average value thereof is greater than angular acceleration of the cylinder other than the cylinder having the largest variation of angular acceleration or an average value thereof, that the amount of air of the cylinder having the largest variation of angular acceleration is greater than the amount of air of the cylinder other than the cylinder having the largest variation of angular acceleration; and means for judging, when angular acceleration of the cylinder having the largest variation of angular acceleration or an average value thereof is smaller than angular acceleration of the cylinder other than the cylinder having the largest variation of angular acceleration or an average value thereof, that the amount of fuel of the cylinder having the largest variation of angular acceleration is smaller than the amount of fuel of the cylinder other than the cylinder having the largest variation of angular acceleration;

wherein the means for correcting the air-fuel ratio of the cylinder having the largest variation of angular acceleration to the rich side corrects the amount of fuel of the cylinder having the largest variation of angular acceleration so as to increase or corrects the amount of air so as to decrease;

wherein the means for correcting the air-fuel ratio of the cylinder having the largest variation of angular acceleration to the rich side corrects the air-fuel ratio by fuel amount increasing correction and then comparing angular acceleration of the cylinder subjected to the fuel amount increasing correction or an average value thereof with angular acceleration of a cylinder other than the cylinder having the largest variation of angular acceleration or an average value thereof; and wherein the means for correcting the air-fuel ratio of the cylinder having the largest variation of angular acceleration to the rich side additionally or alternatively corrects the air-fuel ratio by air amount decreasing correction and then comparing angular acceleration of the cylinder subjected to the air amount decreasing correction or an average value thereof with angular acceleration of the cylinder other than the cylinder having the largest variation of angular acceleration or an average value thereof.

2. The engine control apparatus according to claim 1, wherein the means for correcting the air-fuel ratio of the cylinder other than the cylinder having the largest variation of angular acceleration to the lean side corrects the amount of fuel of the cylinder other than the cylinder having the largest variation of angular acceleration so as to decrease or corrects the amount of air of the cylinder other than the cylinder having the largest variation of angular acceleration so as to increase.

3. The engine control apparatus according to claim 1, further comprising means for correcting the amount of air and amount of fuel of the cylinder judged to have the greater amount of air so as to decrease.

4. The engine control apparatus according to claim 1, further comprising means for correcting ignition timing of the cylinder judged to have the greater amount of air to a retarding side.

5. The engine control apparatus according to claim 1, further comprising means for correcting the amount of air and amount of fuel of the cylinder judged to have the smaller amount of fuel so as to increase.

6. The engine control apparatus according to claim 1, further comprising means for correcting ignition timing of the cylinder judged to have the smaller amount of fuel to an advance angle side.

* * * * *